US010663221B2

(12) United States Patent
Ducote, Jr. et al.

(10) Patent No.: US 10,663,221 B2
(45) Date of Patent: May 26, 2020

(54) MIXED REFRIGERANT SYSTEM AND METHOD

(71) Applicant: Chart Energy & Chemicals, Inc., The Woodlands, TX (US)

(72) Inventors: Douglas A. Ducote, Jr., The Woodlands, TX (US); James Podolski, The Woodlands, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 691 days.

(21) Appl. No.: 15/205,669

(22) Filed: Jul. 8, 2016

(65) Prior Publication Data

US 2017/0010043 A1 Jan. 12, 2017

Related U.S. Application Data

(60) Provisional application No. 62/190,069, filed on Jul. 8, 2015.

(51) Int. Cl.
*F25J 1/02* (2006.01)
*F25J 1/00* (2006.01)
(Continued)

(52) U.S. Cl.
CPC ..... *F25J 1/0217* (2013.01); *F25B 9/006* (2013.01); *F25J 1/0022* (2013.01); *F25J 1/0045* (2013.01);
(Continued)

(58) Field of Classification Search
CPC ..... F25J 1/004; F25J 1/0022; F25J 1/0042; F25J 1/0055; F25J 1/0057; F25J 1/0219; F25J 1/023; F25J 1/0238; F25J 1/0262
See application file for complete search history.

(56) References Cited

U.S. PATENT DOCUMENTS 2,041,725 A 7/1934 Podbielniak
3,364,685 A 1/1968 Perret
(Continued)

FOREIGN PATENT DOCUMENTS

CN 1261654 A 8/2000
CN 202361751 * 8/2012 ..... F25J 1/02
(Continued)

OTHER PUBLICATIONS

International Search Report and Written Opinion issued in International Application No. PCT/US2011/027162 dated May 3, 2011.
(Continued)

*Primary Examiner* — Keith M Raymond
*Assistant Examiner* — Webeshet Mengesha
(74) *Attorney, Agent, or Firm* — Cook Alex Ltd.; R. Blake Johnston

(57) ABSTRACT

A system and method for cooling a gas using a mixed refrigerant includes a compressor system and a heat exchange system, where the compressor system may include an interstage separation device or drum with no liquid outlet, a liquid outlet in fluid communication with a pump that pumps liquid forward to a high pressure separation device or a liquid outlet through which liquid flows to the heat exchanger to be subcooled. In the last situation, the subcooled liquid is expanded and combined with an expanded cold temperature stream, which is a cooled and expanded stream from the vapor side of a cold vapor separation device, and subcooled and expanded streams from liquid sides of the high pressure separation device and the cold vapor separation device, or combined with a stream formed from the subcooled streams from the liquid sides of the high pressure separation device and the cold vapor separation device after mixing and expansion, to form a primary refrigeration stream.

10 Claims, 23 Drawing Sheets

(51) Int. Cl.
*F25B 9/00* (2006.01)
*F25B 1/10* (2006.01)

(52) U.S. Cl.
CPC ..... *F25J 1/0055* (2013.01); *F25J 1/0212* (2013.01); *F25J 1/0231* (2013.01); *F25J 1/0262* (2013.01); *F25J 1/0265* (2013.01); *F25J 1/0291* (2013.01); *F25J 1/0292* (2013.01); *F25J 1/0296* (2013.01); *F25J 1/0298* (2013.01); *F25B 1/10* (2013.01); *F25J 2205/02* (2013.01); *F25J 2205/10* (2013.01); *F25J 2220/60* (2013.01); *F25J 2220/64* (2013.01); *F25J 2230/04* (2013.01); *F25J 2230/08* (2013.01); *F25J 2245/02* (2013.01); *F25J 2245/90* (2013.01); *F25J 2270/66* (2013.01); *F25J 2290/32* (2013.01)

(56) References Cited

U.S. PATENT DOCUMENTS

| | | | | |
|---|---|---|---|---|
| 4,033,735 | A | 7/1977 | Swenson | |
| 4,057,972 | A | 11/1977 | Sarsten | |
| 4,274,849 | A | 6/1981 | Garier et al. | |
| 4,525,185 | A | 6/1985 | Newton | |
| 4,545,795 | A | 10/1985 | Liu et al. | |
| 4,586,942 | A | 5/1986 | Gauthier | |
| 4,689,063 | A | 8/1987 | Paradowski et al. | |
| 4,856,942 | A | 8/1989 | Bernadic et al. | |
| 4,901,533 | A | 2/1990 | Fan et al. | |
| 5,644,931 | A | 7/1997 | Ueno et al. | |
| 5,718,126 | A | 2/1998 | Capron et al. | |
| 5,746,066 | A | 5/1998 | Manley | |
| 5,813,250 | A | 9/1998 | Ueno et al. | |
| 5,950,450 | A | 9/1999 | Bowen et al. | |
| 6,041,619 | A | 3/2000 | Fischer et al. | |
| 6,065,305 | A | 5/2000 | Arman et al. | |
| 6,250,105 | B1 | 6/2001 | Kimble | |
| 6,334,334 | B1 | 1/2002 | Stockmann et al. | |
| 6,347,531 | B1 | 2/2002 | Roberts et al. | |
| 2007/0227185 | A1 | 10/2007 | Stone et al. | |
| 2007/0283718 | A1 | 12/2007 | Hulsey et al. | |
| 2008/0016910 | A1 | 1/2008 | Brostow et al. | |
| 2009/0205366 | A1 | 8/2009 | Schmidt | |
| 2009/0241593 | A1 | 10/2009 | Jager et al. | |
| 2011/0067440 | A1* | 3/2011 | Van Aken | B63B 35/44 62/613 |
| 2011/0219819 | A1 | 9/2011 | Bauer et al. | |
| 2011/0226008 | A1 | 9/2011 | Gushanas et al. | |
| 2012/0047943 | A1 | 3/2012 | Barclay et al. | |
| 2013/0213087 | A1 | 8/2013 | Currence et al. | |
| 2014/0260415 | A1 | 9/2014 | Ducote et al. | |

FOREIGN PATENT DOCUMENTS

| | | | | |
|---|---|---|---|---|
| DE | 19612173 | C1 | 5/1997 | |
| DE | 19937623 | A1 | 2/2001 | |
| DE | 10209799 | | 9/2003 | |
| DE | 10194530 | | 10/2007 | |
| DE | 102010011052 | | 9/2011 | |
| DE | 102011104725 | | 12/2012 | |
| EP | 0008823 | | 3/1980 | |
| EP | 0723125 | A2 | 7/1996 | |
| EP | 0768502 | | 4/1997 | |
| EP | 0644996 | B1 | 12/1998 | |
| EP | 0975923 | A1 | 2/2000 | |
| EP | 1016842 | A2 | 7/2000 | |
| EP | 1092930 | A1 | 4/2001 | |
| EP | 1092931 | A1 | 4/2001 | |
| EP | 1118827 | A1 | 7/2001 | |
| EP | 1144928 | A2 | 10/2001 | |
| EP | 0990108 | B1 | 9/2002 | |
| EP | 1248935 | A1 | 10/2002 | |
| EP | 1137902 | B1 | 1/2003 | |
| EP | 1273860 | A2 | 1/2003 | |
| EP | 1306632 | A1 | 5/2003 | |
| EP | 1309973 | A2 | 5/2003 | |
| EP | 1352203 | A1 | 10/2003 | |
| EP | 1397629 | A1 | 3/2004 | |
| EP | 1092932 | A1 | 12/2004 | |
| EP | 1092933 | B1 | 12/2004 | |
| EP | 1304535 | B1 | 2/2005 | |
| EP | 1455152 | B2 | 7/2005 | |
| EP | 1323994 | B1 | 10/2005 | |
| EP | 1281033 | B1 | 2/2006 | |
| EP | 1668300 | A1 | 6/2006 | |
| EP | 1774234 | | 4/2007 | |
| EP | 1790926 | A1 | 5/2007 | |
| EP | 1812760 | A2 | 8/2007 | |
| EP | 1864062 | A1 | 12/2007 | |
| EP | 1881283 | A2 | 1/2008 | |
| EP | 1929227 | A1 | 6/2008 | |
| EP | 1946026 | A2 | 7/2008 | |
| EP | 2005056 | A2 | 12/2008 | |
| EP | 2052197 | A2 | 4/2009 | |
| EP | 2074364 | A2 | 7/2009 | |
| EP | 2092257 | A2 | 8/2009 | |
| EP | 2110630 | A1 | 10/2009 | |
| EP | 1456589 | B1 | 1/2010 | |
| EP | 2165138 | A2 | 3/2010 | |
| EP | 2185877 | A1 | 5/2010 | |
| EP | 2199716 | A2 | 6/2010 | |
| EP | 2212402 | A1 | 8/2010 | |
| EP | 2229566 | A1 | 9/2010 | |
| EP | 2251625 | A2 | 11/2010 | |
| EP | 2366085 | A2 | 9/2011 | |
| EP | 2399091 | A1 | 12/2011 | |
| EP | 1613910 | B1 | 2/2012 | |
| EP | 2547972 | A1 | 1/2013 | |
| EP | 2550496 | A2 | 1/2013 | |
| EP | 2562501 | A2 | 2/2013 | |
| EP | 1613909 | B1 | 3/2013 | |
| EP | 2600088 | A2 | 6/2013 | |
| FR | 2764972 | | 12/1998 | |
| FR | 2841330 | | 12/2003 | |
| FR | 2885679 | | 11/2006 | |
| FR | 2891900 | A1 | 4/2007 | |
| GB | 1122830 | | 8/1968 | |
| GB | 2326465 | * | 6/1997 | F25J 1/02 |
| GB | 2326465 | A | 12/1998 | |
| GB | 248711 | A | 7/2012 | |
| JP | H8-159652 | | 6/1996 | |
| JP | H9-113129 | | 5/1997 | |
| JP | 2002/508055 | | 3/2002 | |
| JP | 2002/532674 | | 10/2002 | |
| WO | WO94/24500 | | 10/1994 | |
| WO | WO98/48227 | | 10/1998 | |
| WO | WO00/36350 | | 6/2000 | |
| WO | WO 01/39200 | A2 | 5/2001 | |
| WO | WO 01/044735 | | 6/2001 | |
| WO | WO 02/29337 | A1 | 4/2002 | |
| WO | WO 02/050483 | A1 | 6/2002 | |
| WO | WO 02/101307 | A1 | 12/2002 | |
| WO | WO03/074955 | | 9/2003 | |
| WO | WO 2005/028976 | A1 | 3/2005 | |
| WO | WO 2006/007278 | | 1/2006 | |
| WO | WO 2006/009610 | A2 | 1/2006 | |
| WO | WO 2006/047098 | A2 | 5/2006 | |
| WO | WO 2006/094675 | | 9/2006 | |
| WO | WO 2006/120127 | A2 | 11/2006 | |
| WO | WO 2007/021351 | | 2/2007 | |
| WO | WO 2007/042662 | | 4/2007 | |
| WO | WO 2007/120782 | A2 | 10/2007 | |
| WO | WO 2008/006867 | | 1/2008 | |
| WO | WO 2008/020044 | A2 | 2/2008 | |
| WO | WO 2008/034875 | | 3/2008 | |
| WO | WO 2008/074718 | A2 | 6/2008 | |
| WO | WO 2009/007435 | A2 | 1/2009 | |
| WO | WO 2009/050178 | A2 | 4/2009 | |
| WO | WO 2009/029140 | A1 | 5/2009 | |
| WO | WO 2009/061777 | A1 | 5/2009 | |
| WO | WO 2009/085937 | | 7/2009 | |
| WO | WO 2010/058277 | A2 | 5/2010 | |
| WO | WO 2010/096305 | A1 | 8/2010 | |

(56) References Cited

FOREIGN PATENT DOCUMENTS

| | | | |
|---|---|---|---|
| WO | WO 2010/133482 | A2 | 11/2010 |
| WO | WO 2011/115760 | | 9/2011 |
| WO | WO 2011/117655 | | 9/2011 |
| WO | WO 2012/023752 | A2 | 2/2012 |
| WO | WO 2012/075266 | A2 | 6/2012 |
| WO | WO 2012/112692 | A1 | 8/2012 |
| WO | WO 2012/167007 | A1 | 12/2012 |
| WO | WO 2013/055305 | A1 | 4/2013 |
| WO | WO 2013/081979 | A1 | 6/2013 |
| WO | WO 2013/087570 | A2 | 6/2013 |
| WO | WO 2013/087571 | A2 | 6/2013 |
| WO | WO 2014/116363 | A1 | 7/2014 |

OTHER PUBLICATIONS

International Preliminary Report on Patentability International Application No. PCT/US2011/027162 dated Sep. 18, 2012.

Supplementary European Search Report issued in EP11756720 dated Jun. 1, 2015.

International Search Report and Written Opinion of the International Searching Authority, PCT/US2016/026924, dated Aug. 19, 2016.

International Search Report and Written Opinion of the International Searching Authority for PCT/US2014/031135 dated Aug. 19, 2014.

Office Action issued in Mexican Application No. MX/a/2012/010726 dated Mar. 12, 2015 with English translation.

International Search Report and Written Opinion of the International Searching Authority (EPO) dated Dec. 21, 2016 for Interntional Application No. PCT/US2016/041580.

International Preliminary Report on Patentability from PCT/US2014/031135 dated Mar. 9, 2015.

Preliminary Report on Patentability, PCT Appl. No. PCT/US2016/041580 12 pages (Jan. 18, 2018).

Office Action from National Intellectual Property Administration of the People's Republic of China for Chinese Patent Application No. 201680049925.2, dated Oct. 25, 2019 with English Translation (10 pages).

* cited by examiner

MIXED REFRIGERANT SYSTEM AND METHOD

CLAIM OF PRIORITY

This application claims the benefit of U.S. Provisional Application No. 62/190,069, filed Jul. 8, 2015, the contents of which are hereby incorporated by reference.

FIELD OF THE DISCLOSURE

The present invention relates generally to systems and methods for cooling or liquefying gases and, more particularly, to a mixed refrigerant system and method for cooling or liquefying gases.

BACKGROUND OF THE DISCLOSURE

Natural gas and other gases are liquefied for storage and transport. Liquefaction reduces the volume of the gas and is typically carried out by chilling the gas through indirect heat exchange in one or more refrigeration cycles. The refrigeration cycles are costly because of the complexity of the equipment and the performance efficiency of the cycle. There is a need, therefore, for gas cooling and/or liquefaction systems that lower equipment cost and that are less complex, more efficient, and less expensive to operate.

Liquefying natural gas, which is primarily methane, typically requires cooling the gas stream to approximately −160° C. to −170° C. and then letting down the pressure to approximately atmospheric. Typical temperature-enthalpy curves for liquefying gaseous methane, have three regions along an S-shaped curve. As the gas is cooled, at temperatures above about −75° C. the gas is de-superheating; and at temperatures below about −90° C. the liquid is subcooling. Between these temperatures, a relatively flat region is observed in which the gas is condensing into liquid.

Refrigeration processes supply the requisite cooling for liquefying natural gas, and the most efficient of these have heating curves that closely approach the cooling curves for natural gas, ideally to within a few degrees throughout the entire temperature range. However, because the cooling curves feature an S-shaped profile and a large temperature range, such refrigeration processes are difficult to design. Pure component refrigerant processes, because of their flat vaporization curves, work best in the two-phase region. Multi-component refrigerant processes, on the other hand, have sloping vaporization curves and are more appropriate for the de-superheating and subcooling regions. Both types of processes, and hybrids of the two, have been developed for liquefying natural gas Cascaded, multilevel, pure component refrigeration cycles were initially used with refrigerants such as propylene, ethylene, methane, and nitrogen. With enough levels, such cycles can generate a net heating curve that approximates the cooling curves shown in FIG. 1. However, as the number of levels increases, additional compressor trains are required, which undesirably adds to the mechanical complexity. Further, such processes are thermodynamically inefficient because the pure component refrigerants vaporize at constant temperature instead of following the natural gas cooling curve, and the refrigeration valve irreversibly flashes the liquid into vapor. For these reasons, mixed refrigerant processes have become popular to reduce capital costs and energy consumption and to improve operability.

U.S. Pat. No. 5,746,066 to Manley describes a cascaded, multilevel, mixed refrigerant process for ethylene recovery, which eliminates the thermodynamic inefficiencies of the cascaded multilevel pure component process. This is because the refrigerants vaporize at rising temperatures following the gas cooling curve, and the liquid refrigerant is subcooled before flashing thus reducing thermodynamic irreversibility. Mechanical complexity is somewhat reduced because fewer refrigerant cycles are required compared to pure refrigerant processes. See, e.g., U.S. Pat. No. 4,525,185 to Newton; U.S. Pat. No. 4,545,795 to Liu et al.; U.S. Pat. No. 4,689,063 to Paradowski et al.; and U.S. Pat. No. 6,041,619 to Fischer et al.; and U.S. Patent Application Publication Nos. 2007/0227185 to Stone et al. and 2007/0283718 to Hulsey et al.

The cascaded, multilevel, mixed refrigerant process is among the most efficient known, but a simpler, more efficient process, which can be more easily operated, is desirable.

A single mixed refrigerant process, which requires only one compressor for refrigeration and which further reduces the mechanical complexity has been developed. See, e.g., U.S. Pat. No. 4,033,735 to Swenson. However, for primarily two reasons, this process consumes somewhat more power than the cascaded, multilevel, mixed refrigerant processes discussed above.

First, it is difficult, if not impossible, to find a single mixed refrigerant composition that generates a net heating curve that closely approximates the typical natural gas cooling curve. Such a refrigerant requires a range of relatively high and low boiling components, whose boiling temperatures are thermodynamically constrained by the phase equilibrium. Higher boiling components are further limited in order to avoid their freezing out at low temperatures. The undesirable result is that relatively large temperature differences necessarily occur at several points in the cooling process, which is inefficient in the context of power consumption.

Second, in single mixed refrigerant processes, all of the refrigerant components are carried to the lowest temperature even though the higher boiling components provide refrigeration only at the warmer end of the process. The undesirable result is that energy must be expended to cool and reheat those components that are "inert" at the lower temperatures. This is not the case with either the cascaded, multilevel, pure component refrigeration process or the cascaded, multilevel, mixed refrigerant process.

To mitigate this second inefficiency and also address the first, numerous solutions have been developed that separate a heavier fraction from a single mixed refrigerant, use the heavier fraction at the higher temperature levels of refrigeration, and then recombine the heavier fraction with the lighter fraction for subsequent compression. See, e.g., U.S. Pat. No. 2,041,725 to Podbielniak; U.S. Pat. No. 3,364,685 to Perret; U.S. Pat. No. 4,057,972 to Sarsten; U.S. Pat. No. 4,274,849 to Garrier et al.; U.S. Pat. No. 4,901,533 to Fan et al.; U.S. Pat. No. 5,644,931 to Ueno et al.; U.S. Pat. No. 5,813,250 to Ueno et al; U.S. Pat. No. 6,065,305 to Arman et al.; and U.S. Pat. No. 6,347,531 to Roberts et al.; and U.S. Patent Application Publication No. 2009/0205366 to Schmidt. With careful design, these processes can improve energy efficiency even though the recombining of streams not at equilibrium is thermodynamically inefficient. This is because the light and heavy fractions are separated at high pressure and then recombined at low pressure so that they may be compressed together in a single compressor. Generally, when streams are separated at equilibrium, separately processed, and then recombined at non-equilibrium conditions, a thermodynamic loss occurs, which ultimately increases power consumption. Therefore the number of such separations should be minimized. All of these processes use simple vapor/liquid equilibrium at various places in the refrigeration process to separate a heavier fraction from a lighter one.

Simple one-stage vapor/liquid equilibrium separation, however, doesn't concentrate the fractions as much as using multiple equilibrium stages with reflux. Greater concentration allows greater precision in isolating a composition that provides refrigeration over a specific range of temperatures. This enhances the process ability to follow the typical gas cooling curves. U.S. Pat. No. 4,586,942 to Gauthier and U.S. Pat. No. 6,334,334 to Stockmann et al. (the latter marketed by Linde as the LIMUM®3 process) describe how fractionation may be employed in the above ambient compressor train to further concentrate the separated fractions used for refrigeration in different temperature zones and thus improve the overall process thermodynamic efficiency. A second reason for concentrating the fractions and reducing their temperature range of vaporization is to ensure that they are completely vaporized when they leave the refrigerated part of the process. This fully utilizes the latent heat of the refrigerant and precludes the entrainment of liquids into downstream compressors. For this same reason heavy fraction liquids are normally re-injected into the lighter fraction of the refrigerant as part of the process. Fractionation of the heavy fractions reduces flashing upon re-injection and improves the mechanical distribution of the two phase fluids.

As illustrated by U.S. Patent Application Publication No. 2007/0227185 to Stone et al., it is known to remove partially vaporized refrigeration streams from the refrigerated portion of the process. Stone et al. does this for mechanical (and not thermodynamic) reasons and in the context of a cascaded, multilevel, mixed refrigerant process that requires two separate mixed refrigerants. The partially vaporized refrigeration streams are completely vaporized upon recombination with their previously separated vapor fractions immediately prior to compression.

Multi-stream, mixed refrigerant systems are known in which simple equilibrium separation of a heavy fraction was found to significantly improve the mixed refrigerant process efficiency if that heavy fraction isn't entirely vaporized as it leaves the primary heat exchanger. See, e.g., U.S. Patent Application Publication No. 2011/0226008 to Gushanas et al. Liquid refrigerant, if present at the compressor suction, must be separated beforehand and sometimes pumped to a higher pressure. When the liquid refrigerant is mixed with the vaporized lighter fraction of the refrigerant, the compressor suction gas is cooled, which further reduces the power required. Heavy components of the refrigerant are kept out of the cold end of the heat exchanger, which reduces the possibility of refrigerant freezing. Also, equilibrium separation of the heavy fraction during an intermediate stage reduces the load on the second or higher stage compressor (s), which improves process efficiency. Use of the heavy fraction in an independent pre-cool refrigeration loop can result in a near closure of the heating/cooling curves at the warm end of the heat exchanger, which results in more efficient refrigeration.

"Cold vapor" separation has been used to fractionate high pressure vapor into liquid and vapor streams. See, e.g., U.S. Pat. No. 6,334,334 to Stockmann et al., discussed above; "State of the Art LNG Technology in China", Lange, M., 5$^{th}$ Asia LNG Summit, Oct. 14, 2010; "Cryogenic Mixed Refrigerant Processes", International Cryogenics Monograph Series, Venkatarathnam, G., Springer, pp 199-205; and "Efficiency of Mid Scale LNG Processes Under Different Operating Conditions", Bauer, H., Linde Engineering. In another process, marketed by Air Products as the AP-SMR™ LNG process, a "warm", mixed refrigerant vapor is separated into cold mixed refrigerant liquid and vapor streams. See, e.g., "Innovations in Natural Gas Liquefaction Technology for Future LNG Plants and Floating LNG Facilities", International Gas Union Research Conference 2011, Bukowski, J. et al. In these processes, the thus-separated cold liquid is used as the middle temperature refrigerant by itself and remains separate from the thus-separated cold vapor prior to joining a common return stream. The cold liquid and vapor streams, together with the rest of the returning refrigerants, are recombined via cascade and exit together from the bottom of the heat exchanger.

In the vapor separation systems discussed above, the warm temperature refrigeration used to partially condense the liquid in the cold vapor separator is produced by the liquid from the high-pressure accumulator. This requires higher pressure and less than ideal temperatures, both of which undesirably consume more power during operation.

Another process that uses cold vapor separation, albeit in a multi-stage, mixed refrigerant system, is described in GB Pat. No. 2,326,464 to Costain Oil. In this system, vapor from a separate reflux heat exchanger is partially condensed and separated into liquid and vapor streams. The thus-separated liquid and vapor streams are cooled and separately flashed before rejoining in a low-pressure return stream. Then, before exiting the main heat exchanger, the low-pressure return stream is combined with a subcooled and flashed liquid from the aforementioned reflux heat exchanger and then further combined with a subcooled and flashed liquid provided by a separation drum set between the compressor stages. In this system, the "cold vapor" separated liquid and the liquid from the aforementioned reflux heat exchanger are not combined prior to joining the low-pressure return stream. That is, they remain separate before independently joining up with the low-pressure return stream.

Power consumption can be significantly reduced by, inter alia, mixing a liquid obtained from a high pressure accumulator with the cold vapor separated liquid prior to their joining a return stream.

It is desirable to provide a mixed gas system and method for cooling or liquefying a gas that addresses at least some of the above issues and improves efficiency.

SUMMARY OF THE DISCLOSURE

There are several aspects of the present subject matter which may be embodied separately or together in the methods, devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system for cooling a gas with a mixed refrigerant is provided and includes a main heat exchanger including a warm end and a cold end with a feed stream cooling passage extending therebetween, with the feed stream cooling passage being adapted to receive a feed stream at the warm end and to convey a cooled product stream out of the cold end. The main heat exchanger also includes a high pressure vapor cooling passage, a high pressure liquid cooling passage, a cold separator vapor cooling passage, a cold separator liquid cooling passage and a refrigeration passage.

The system also includes a mixed refrigerant compressor system including a compressor first section having an inlet in fluid communication with an outlet of the refrigeration passage and an outlet. A first section cooler has an inlet in fluid communication with the outlet of the compressor first section and an outlet. An interstage separation device has an inlet in fluid communication with the outlet of the first section cooler and a liquid outlet and a vapor outlet. A compressor second section has an inlet in fluid communication with the vapor outlet of the interstage separation device and an outlet. A second section cooler has an inlet in fluid communication with the outlet of the compressor second section and an outlet. A high pressure separation device has an inlet in fluid communication with the outlet of the second section cooler and a liquid outlet and a vapor outlet.

The high pressure vapor cooling passage of the heat exchanger has an inlet in fluid communication with the vapor outlet of the high pressure separation device and a cold vapor separator has an inlet in fluid communication with an outlet of the high pressure vapor cooling passage, where the cold vapor separator has a liquid outlet and a vapor outlet. The cold separator liquid cooling passage of the heat exchanger has an inlet in fluid communication with the liquid outlet of the cold vapor separator and an outlet in fluid communication with the refrigeration passage. The low pressure liquid cooling passage of the heat exchanger has an inlet in fluid communication with the liquid outlet of the interstage separation device. A first expansion device has an inlet in communication with an outlet of the low pressure liquid cooling passage and an outlet in fluid communication with the refrigeration passage. The high pressure liquid cooling passage of the heat exchanger has an inlet in fluid communication with the liquid outlet of the high pressure separation device and an outlet in fluid communication with the refrigeration passage. The cold separator vapor cooling passage of the heat exchanger has an inlet in fluid communication with the vapor outlet of the cold vapor separator. A second expansion device having an inlet in fluid communication with an outlet of the cold separator vapor cooling passage and an outlet in fluid communication with an inlet of the refrigeration passage.

In another aspect, a system for cooling a gas with a mixed refrigerant includes a main heat exchanger including a warm end and a cold end with a feed stream cooling passage extending therebetween. The feed stream cooling passage is adapted to receive a feed stream at the warm end and to convey a cooled product stream out of the cold end. The main heat exchanger also includes a high pressure vapor cooling passage, a high pressure liquid cooling passage, a cold separator vapor cooling passage, a cold separator liquid cooling passage and a refrigeration passage.

The system also includes a mixed refrigerant compressor system including a compressor first section having an inlet in fluid communication with an outlet of the refrigeration passage and an outlet. A first section cooler has an inlet in fluid communication with the outlet of the compressor first section and an outlet. An interstage separation device has an inlet in fluid communication with the outlet of the first section cooler and a vapor outlet. A compressor second section has an inlet in fluid communication with the vapor outlet of the interstage separation device and an outlet. A second section cooler has an inlet in fluid communication with the outlet of the compressor second section and an outlet. A high pressure separation device has an inlet in fluid communication with the outlet of the second section cooler and a liquid outlet and a vapor outlet.

The high pressure vapor cooling passage of the heat exchanger has an inlet in fluid communication with the vapor outlet of the high pressure separation device. A cold vapor separator has an inlet in fluid communication with an outlet of the high pressure vapor cooling passage, where the cold vapor separator has a liquid outlet and a vapor outlet. The cold separator liquid cooling passage of the heat exchanger has an inlet in fluid communication with the liquid outlet of the cold vapor separator and an outlet in fluid communication with the refrigeration passage. The high pressure liquid cooling passage of the heat exchanger has an inlet in fluid communication with the liquid outlet of the high pressure separation device and an outlet in fluid communication with the refrigeration passage. The cold separator vapor cooling passage of the heat exchanger has an inlet in fluid communication with the vapor outlet of the cold vapor separator. An expansion device has an inlet in fluid communication with an outlet of the cold separator vapor cooling passage and an outlet in fluid communication with an inlet of the refrigeration passage.

In yet another aspect, a compressor system for providing mixed refrigerant to a heat exchanger for cooling a gas is provided and includes a compressor first section having a suction inlet adapted to receive a mixed refrigerant from a heat exchanger and an outlet. A first section cooler has an inlet in fluid communication with the outlet of the compressor first section and an outlet. An interstage separation device has an inlet in fluid communication with the outlet of the first section after-cooler and a vapor outlet. A compressor second section has a suction inlet in fluid communication with the vapor outlet of the interstage separation device and an outlet. A second section cooler has an inlet in fluid communication with the outlet of the compressor second section and an outlet. A high pressure separation device has an inlet in fluid communication with the outlet of the second section cooler and a vapor outlet and a liquid outlet, with the vapor outlet adapted to provide a high pressure mixed refrigerant vapor stream to the heat exchanger and said liquid outlet adapted to provide a high pressure mixed refrigerant liquid stream to the heat exchanger. A high pressure recycle expansion device has an inlet in fluid communication with the high pressure separation device and an outlet in fluid communication with the interstage separation device.

In yet another aspect, a method of cooling a gas in a heat exchanger having a warm end and a cold end using a mixed refrigerant includes compressing and cooling a mixed refrigerant using first and last compression and cooling cycles, separating the mixed refrigerant after the first and last compression and cooling cycles so that a high pressure liquid stream and a high pressure vapor stream are formed, cooling and separating the high pressure vapor stream using the heat exchanger and a cold separator so that a cold separator vapor stream and a cold separator liquid stream are formed, cooling and expanding the cold separator vapor stream so that an expanded cold temperature stream is formed, cooling the cold separator liquid stream so that a subcooled cold separator stream is formed, equilibrating and separating the mixed refrigerant between the first and last compression and cooling cycles so that a low pressure liquid stream is formed, cooling and expanding the low pressure liquid stream so that an expanded low pressure stream is formed and subcooling the high pressure liquid stream so that a subcooled high pressure stream is formed. The subcooled cold separator stream and the subcooled high pressure stream are expanded to form an expanded cold separator stream and an expanded high pressure stream or mixed and then expanded to form a middle temperature stream. The expanded streams or middle temperature stream are or is combined with the expanded low pressure stream and the expanded cold temperature stream to form a primary refrigeration stream. A stream of gas is passed through the heat exchanger in countercurrent heat exchange with the primary refrigeration stream so that the gas is cooled.

DETAILED DESCRIPTION OF EMBODIMENTS

It should be noted that while the embodiments are illustrated and described below in terms of liquefying natural gas to produce liquid natural gas, the invention may be used to liquefy or cool other types of fluids.

It should also be noted herein that the passages and streams described in the embodiments below are sometimes both referred to by the same element number set out in the figures. Also, as used herein, and as known in the art, a heat exchanger is that device or an area in the device wherein indirect heat exchange occurs between two or more streams at different temperatures, or between a stream and the environment. As used herein, the terms "communication", "communicating", and the like generally refer to fluid communication unless otherwise specified. And although two fluids in communication may exchange heat upon mixing, such an exchange would not be considered to be the same as heat exchange in a heat exchanger, although such an exchange can take place in a heat exchanger. A heat exchange system can include those items though not specifically described are generally known in the art to be part of, or associated with, a heat exchanger, such as expansion devices, flash valves, and the like. As used herein, the term "reducing the pressure of" does not involve a phase change, while the term "flashing" or "flashed" does involve a phase change, including even a partial phase change. As used herein, the terms, "high", "middle", "warm" and the like are relative to comparable streams, as is customary in the art and illustrated by U.S. patent application Ser. No. 12/726,142, filed Mar. 17, 2010, and U.S. patent application Ser. No.

14/218,949, filed Mar. 18, 2014, the contents of each of which are hereby incorporated by reference. The contents of U.S. Pat. No. 6,333,445, issued Dec. 25, 2001, are also hereby incorporated by reference.

Figure 1:
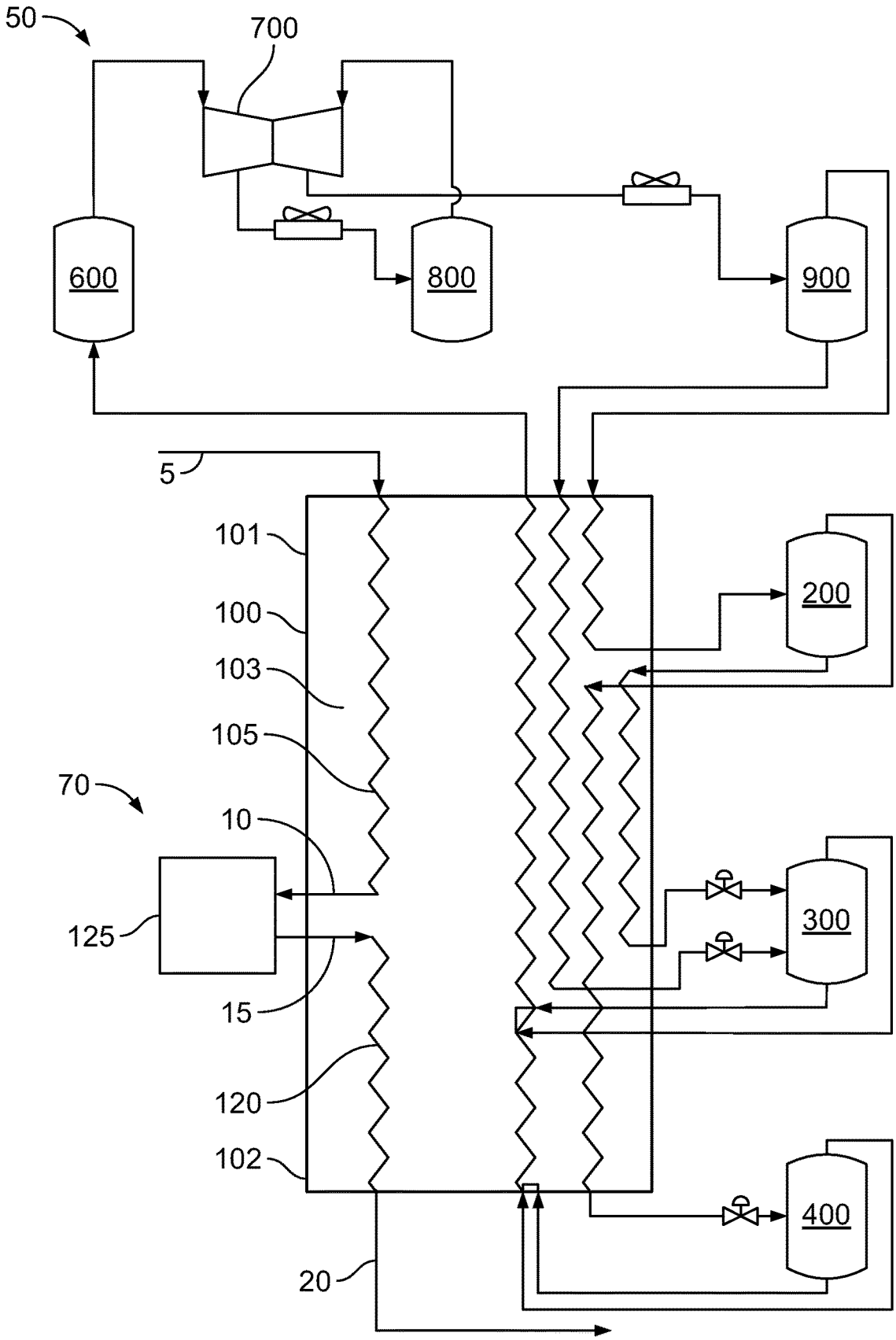
FIG. 1 is a process flow diagram and schematic illustrating an embodiment of the mixed refrigerant system and method of the disclosure.
Figure 2:
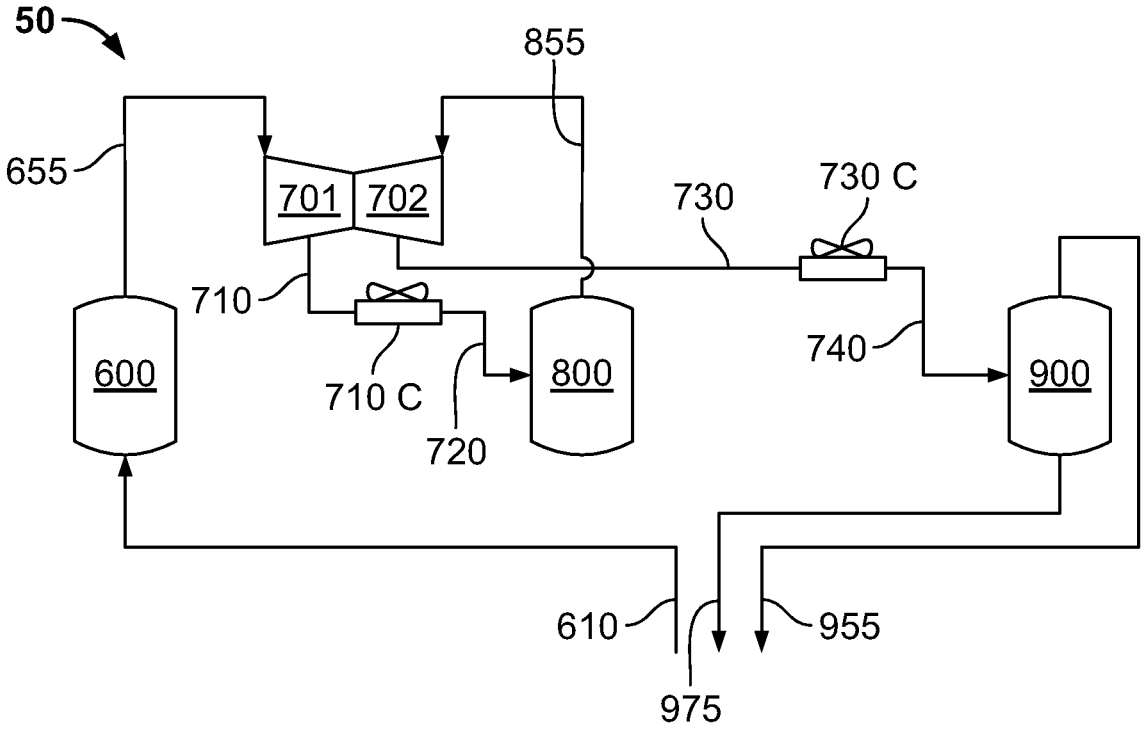
FIG. 2 is a process flow diagram and schematic of the mixed refrigerant compressor system of the mixed refrigerant system of FIG. 1.

A first embodiment of a mixed refrigerant system and method is illustrated in FIG. 1. The system includes a mixed refrigerant (MR) compressor system, indicated in general at 50, and a heat exchange system, indicated in general at 70.

The heat exchange system includes a multi-stream heat exchanger, indicated in general at 100, having a warm end 101 and a cold end 102. The heat exchanger receives a high pressure natural gas feed stream 5 that is liquefied in feed stream cooling passage 103, which is made up of feed stream cooling passage 105 and treated feed stream cooling passage 120, via removal of heat via heat exchange with refrigeration streams in the heat exchanger. As a result, a stream 20 of liquid natural gas (LNG) product is produced. The multi-stream design of the heat exchanger allows for convenient and energy-efficient integration of several streams into a single exchanger. Suitable heat exchangers may be purchased from Chart Energy & Chemicals, Inc. of The Woodlands, Tex. The plate and fin multi-stream heat exchanger available from Chart Energy & Chemicals, Inc. offers the further advantage of being physically compact.

As will be explained in greater detail below, the system of FIG. 1, including heat exchanger 100, may be configured to perform other gas processing or feed gas treatment options 125 known in the prior art. These processing options may require the gas stream to exit and reenter the heat exchanger one or more times (as illustrated in FIG. 1) and may include, for example, natural gas liquids recovery, freezing component removal or nitrogen rejection.

The removal of heat is accomplished in the heat exchanger 100 of the heat exchange system 70 (and other heat exchange systems described herein) using a single mixed refrigerant that is processed and reconditioned using the MR compressor system 50 (and other MR compressor systems described herein). As an example only, the mixed refrigerant may include two or more C1-C5 hydrocarbons and optionally $N_2$. Furthermore, the mixed refrigerant may include two or more of methane, ethane, ethylene, propane, propylene, isobutane, n-butane, isobutene, butylene, n-pentane, isopentane, $N_2$, or a combination thereof. More detailed exemplary refrigerant compositions (along with stream temperature and pressures), which are not intended to be limiting, are presented in U.S. patent application Ser. No. 14/218,949, filed Mar. 18, 2014.

The heat exchange system 70 includes a cold vapor separator 200, a mid-temperature standpipe 300 and a cold temperature standpipe 400 that receive mixed refrigerant from, and return mixed refrigerant to, the heat exchanger 100.

The MR compressor system includes a suction drum 600, a multi-stage compressor 700, an interstage separation device or drum 800 and a high pressure separation device 900. While accumulation or separation drums are illustrated for devices 200, 300, 400, 600, 800 and 900, alternative separation devices may be used, including, but not limited to, another type of vessel, a cyclonic separator, a distillation unit, a coalescing separator or mesh or vane type mist eliminator.

It is to be understood that the suction drum 600 may be omitted in embodiments that use compressors that do not require a suction drum for their inlets. A non-limiting example of such a compressor is a screw compressor.

The functionality and additional components of the MR compressor system 50 and heat exchange system 70 will now be described.

The compressor first section 701 includes a compressed fluid outlet for providing a compressed suction drum MR vapor stream 710 to first section cooler 710C so that cooled compressed suction drum MR stream 720 is provided to interstage separation device or drum 800. The stream 720 travels to the interstage separation device or drum 800 and the resulting low pressure MR vapor stream 855 is provided to the compressor second section 702. The compressor second section 702 provides a compressed high pressure MR vapor stream 730 to the second section cooler 730C. As a result, a high pressure MR stream 740 that is at least partially condensed travels to high pressure separation device 900.

It is to be understood that, in the present and following embodiments, there could be one or more additional intermediate compression/compressor and cooling/cooler sections between the first compression and cooling section and the second compression and cooling section so that the compressor second section and the second section cooler are the last compressor section and the last section cooler. It should be further understood that while the compressors 701 and 702 are illustrated and described as different sections of a multi-stage compressor, the compressors 701 and 702 may instead be separate compressors including two or more compressors.

The high pressure separation device 900 equilibrates and separates the MR stream 740 into a high pressure MR vapor stream 955 and a high pressure MR liquid stream 975, which is preferably a mid-boiling refrigerant liquid stream.

Figure 3:
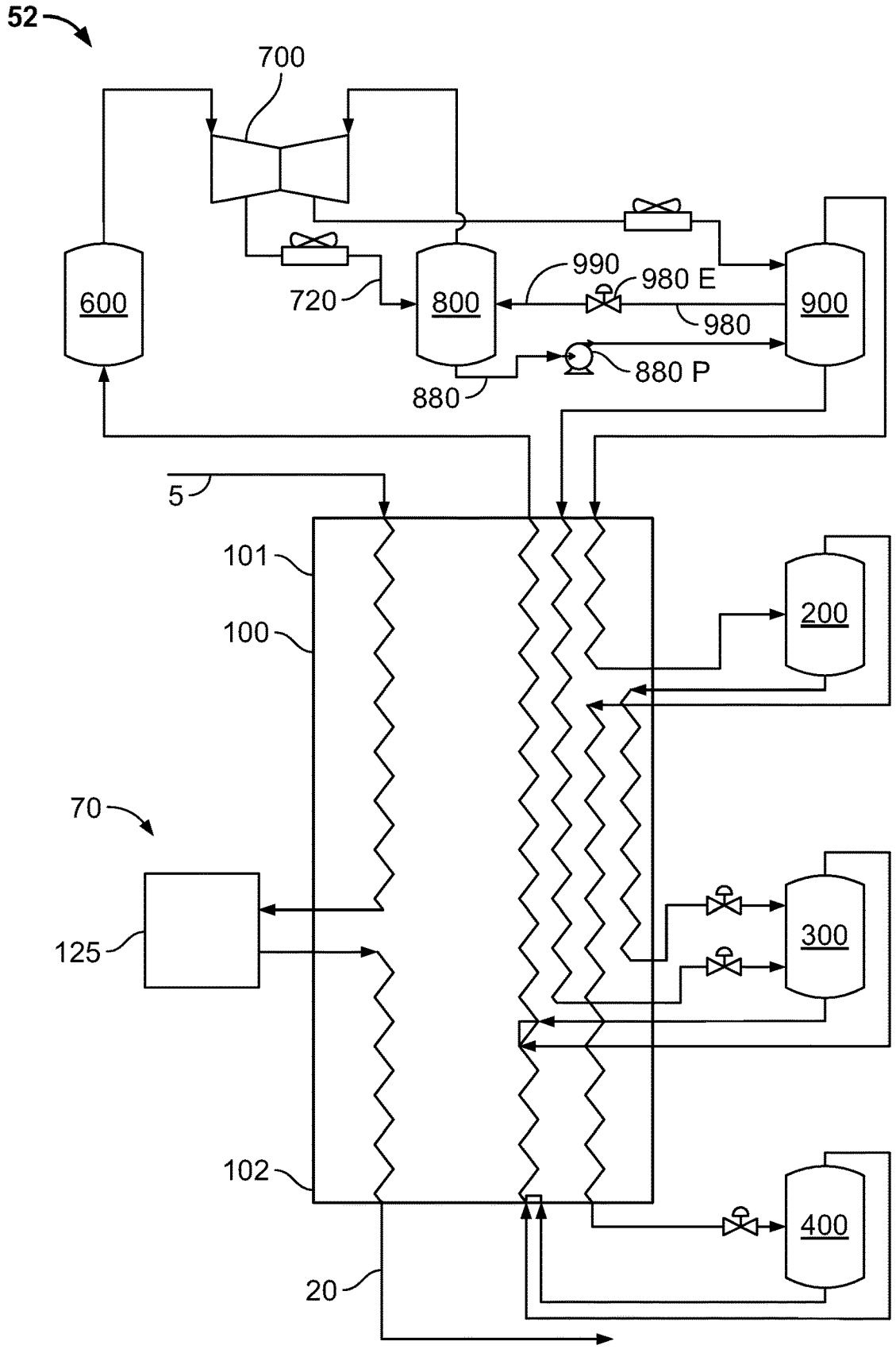
FIG. 3 is a process flow diagram and schematic illustrating an additional embodiment of the mixed refrigerant system and method of the disclosure.

In an alternative embodiment of the MR compressor system, indicated in general at 52 in FIG. 3, an optional interstage drum pump 880P is provided for pumping an MR forward liquid stream 880 to the high pressure separation device 900, so that the stream from pump 880P and stream 740 are combined and equilibrated in separation device 900, in the event that cooled compressed suction drum MR stream 720 is partially condensed when it enters interstage drum 800. As examples only, the stream exiting the pump 880P may have a pressure of 600 psig and a temperature of 100° F.

Furthermore, MR compressor system 52 may optionally provide a high pressure MR recycle liquid stream 980 from high pressure separation device 900 to an expansion device 980E so that a high pressure MR recycle mixed phase stream 990 is provided to interstage drum 800 so that streams 720 and 990 are combined and equilibrated. Recycling liquid from the high pressure separation device 900 to the interstage drum 800 keeps the pump 880P running under conditions which the interstage drum would otherwise not receive a sufficient supply of cool liquid, such as when warm ambient temperatures exist (i.e. on a hot day). Opening the device 980E eliminates the necessity of shutting the pump 880P off until sufficient liquid is collected, and thus keeps a constant composition of refrigerant flowing to the high pressure separation device 900. As examples only, stream 980 may have a pressure of 600 psig and a temperature of 100° F., while stream 990 may have a pressure of 200 psig and a temperature of 60° F.

Figure 4:
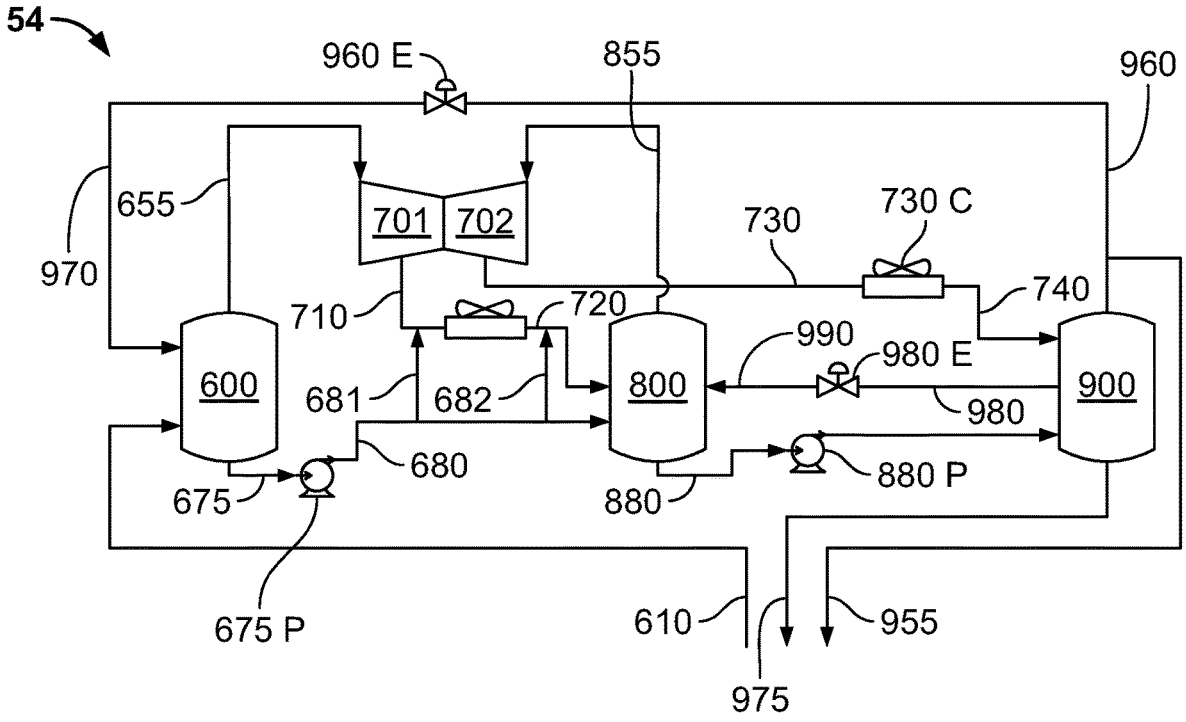
FIG. 4 is a process flow diagram and schematic illustrating a mixed refrigerant compressor system in an additional embodiment of the mixed refrigerant system and method of the disclosure.

In another alternative embodiment of the MR compressor system, indicated in general at 54 in FIG. 4, a mixed phase primary MR stream 610 is returned from the heat exchanger of FIGS. 1 and 3 to the suction separation device 600. The suction separation device 600 has a liquid outlet through which a suction drum MR liquid stream 675 exits the drum. The stream 675 travels to a suction drum pump 675P, which produces suction drum MR stream 680, which travels to interstage drum 800. Alternatively, stream 680 may flow via branch stream 681 to the compressed suction drum MR vapor stream 710. As yet another alternative, stream 680 may flow via branch stream 682 to the cooled compressed suction drum MR stream 720.

As further illustrated in FIG. 4, and as known in the art, a compressor capacity or surge control system is provided that includes an MR recycle vapor line 960, an anti-surge recycle valve 960E and a line 970 running from the anti-surge recycle valve 960E outlet to the suction separation device 600. Alternative compressor capacity or surge control arrangements known in the art may be used in place of the capacity or surge control system illustrated FIG. 4.

Figure 5:
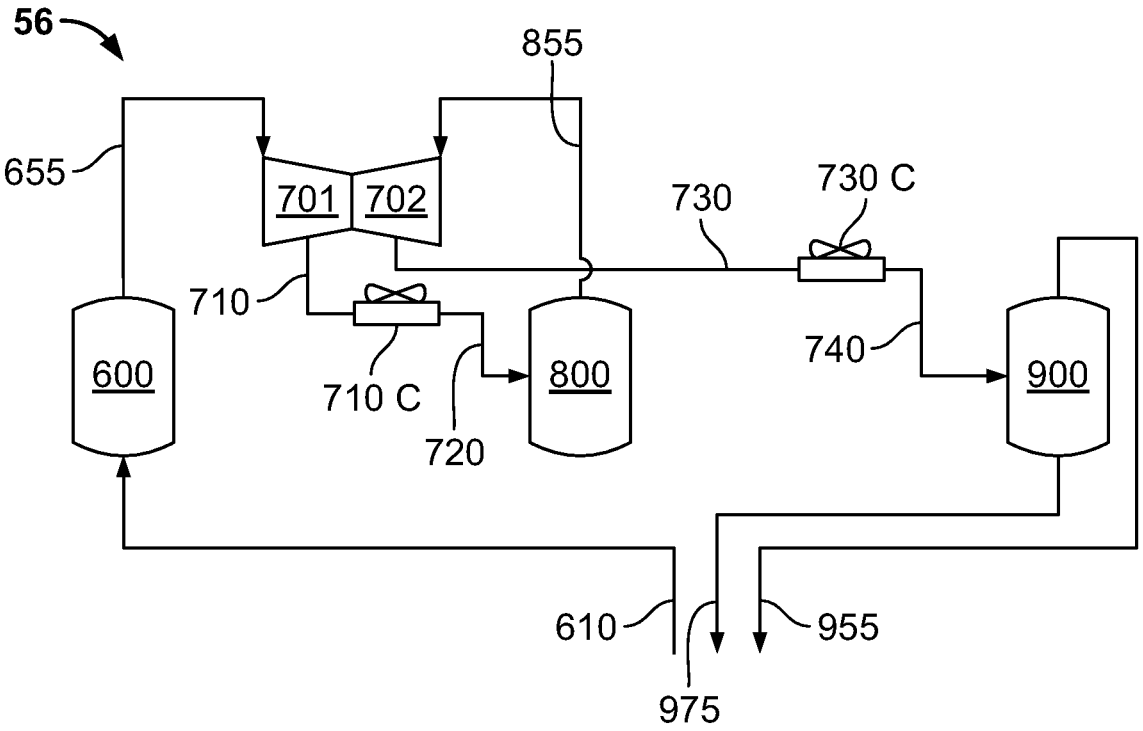
FIG. 5 is a process flow diagram and schematic illustrating a mixed refrigerant compressor system in an additional embodiment of the mixed refrigerant system and method of the disclosure.

In a simplified, alternative embodiment of the MR compressor system, indicated in general at 56 of FIG. 5, and as in previous embodiments, the suction separation device 600 includes an inlet for receiving a vapor primary MR stream 610 from a refrigeration passage of the heat exchanger of FIG. 1. The suction drum MR vapor stream 655 is provided from an outlet of the suction drum to the compressor first section 701.

The compressor first section 701 includes a compressed fluid outlet for providing a compressed suction drum MR vapor stream 710 to first section cooler 710C so that cooled compressed suction drum MR stream 720 is provided to interstage drum 800. The stream 720 travels to the interstage drum 800 and the resulting low pressure MR vapor stream 855 is provided to the compressor second section 702. The compressor second section 702 provides a compressed high pressure MR vapor stream 730 to the second section cooler 730C. As a result, a high pressure MR stream 740 that is at least partially condensed travels to high pressure separation device 900.

The high pressure separation device 900 separates the MR stream 740 into a high pressure MR vapor stream 955 and a high pressure MR liquid stream 975, which is preferably a mid-boiling refrigerant liquid stream.

Figure 6:
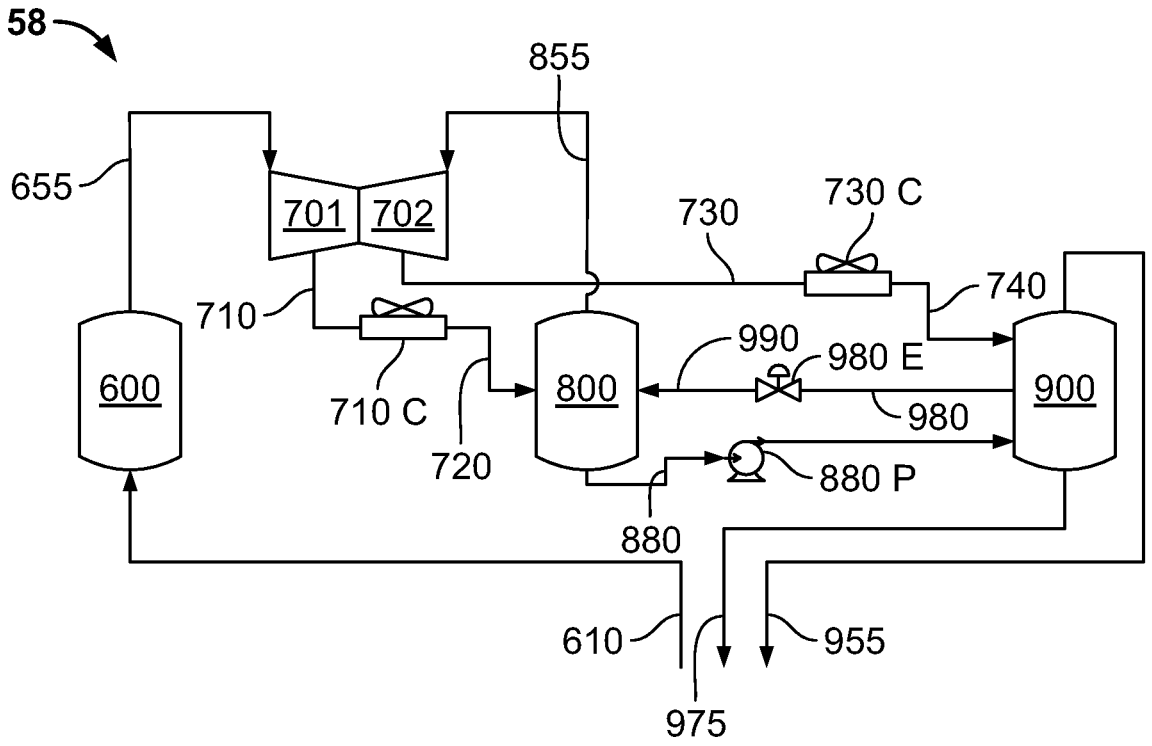
FIG. 6 is a process flow diagram and schematic illustrating a mixed refrigerant compressor system in an additional embodiment of the mixed refrigerant system and method of the disclosure.

In an alternative embodiment of the MR compressor system, indicated in general at 58 in FIG. 6, an optional interstage drum pump 880P is provided for pumping an MR forward liquid stream 880 from interstage drum 800 to the high pressure separation device 900 in the event that cooled compressed suction drum MR stream 720 is partially condensed when it enters interstage drum 800. Furthermore, MR compressor system 58 may optionally provide a high pressure MR recycle liquid stream 980 from high pressure separation device 900 to an expansion device 980E so that a high pressure MR recycle mixed phase stream 990 is provided to separation device drum 800.

Otherwise, the MR compressor system 58 of FIG. 6 is the same as MR compressor system 54 of FIG. 5.

Figure 7:
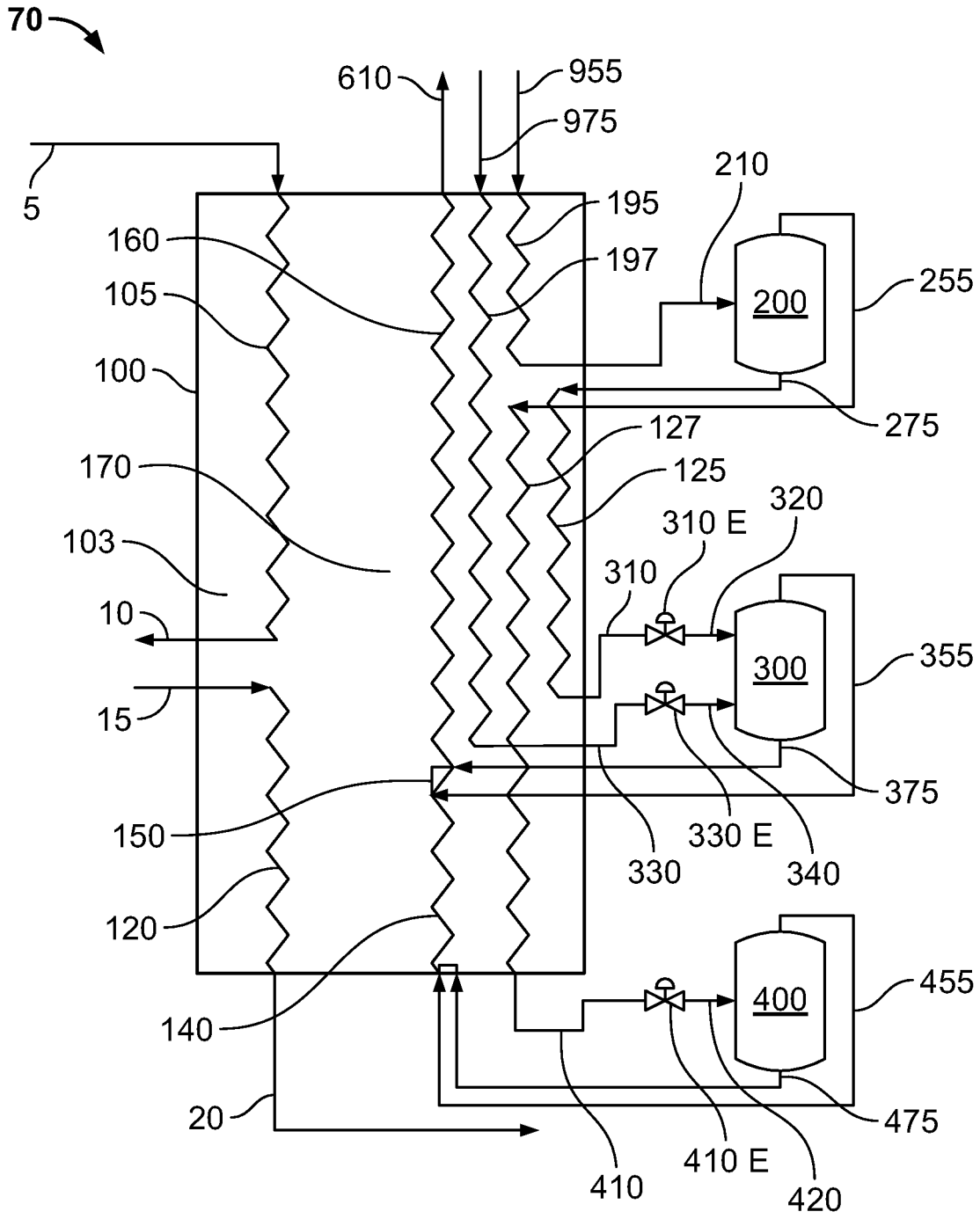
FIG. 7 is a process flow diagram and schematic illustrating a heat exchange system in an additional embodiment of the mixed refrigerant system and method of the disclosure.

The heat exchange system 70 of FIGS. 1 and 3 may be used with each of the MR compressor systems described above (and with alternative MR compressor system embodiments), and will now be discussed in detail with reference to FIG. 7. As illustrated in FIG. 7, and noted previously, the multi-stream heat exchanger 100 receives a feed fluid stream, such as a high pressure natural gas feed stream 5, that is cooled and/or liquefied in feed stream cooling passage 103 via removal of heat via heat exchange with refrigeration streams in the heat exchanger. As a result, a stream of product fluid 20 such as liquid natural gas, is produced.

The feed stream cooling passage 103 includes a pre-treatment feed stream cooling passage 105, having an inlet at the warm end of heat exchanger 100, and a treated feed stream cooling passage 120 having a product outlet at the cold end through which product 20 exits. The pre-treatment feed stream cooling passage 105 has an outlet that joins feed fluid outlet 10 while treated feed stream cooling passage 120 has an inlet in communication with feed fluid inlet 15. Feed fluid outlet and inlet 10 and 15 are provided for external feed treatment (125 in FIGS. 1 and 3), such as natural gas liquids recovery, freezing component removal or nitrogen rejection, or the like. An example of an external feed treatment system is presented below with reference to FIGS. 23-25.

Figure 8:
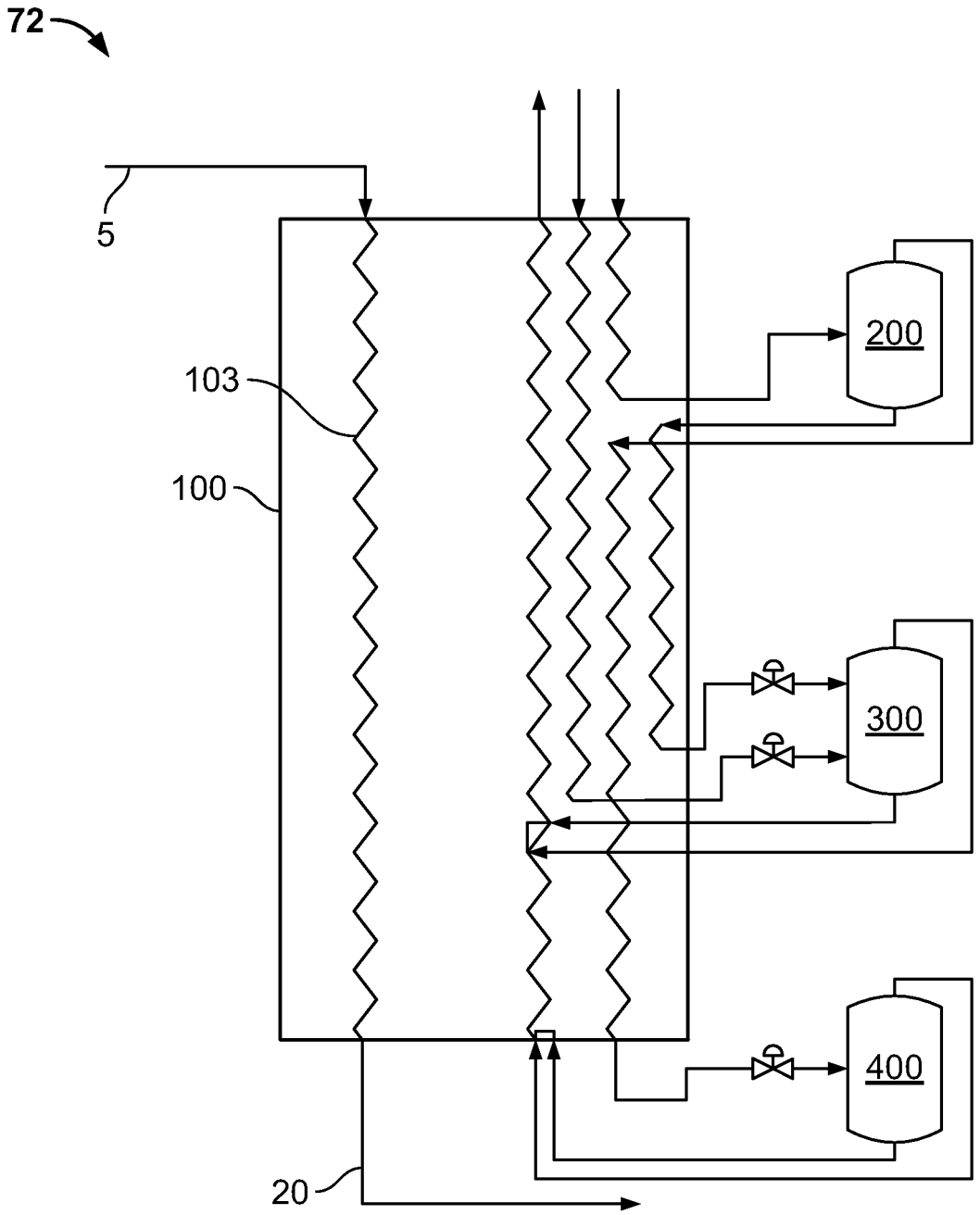
FIG. 8 is a process flow diagram and schematic illustrating a heat exchange system in an additional embodiment of the mixed refrigerant system and method of the disclosure.

In an alternative embodiment of the heat exchange system, indicated in general at 72 in FIG. 8, the feed stream cooling passage 103 passes between the warm and cold ends of the heat exchanger 100 without interruption. Such an embodiment may be used when external feed treatment systems are not heat integrated with the heat exchanger 100.

The heat exchanger includes a refrigeration passage, indicated in general at 170 in FIG. 7, that includes a cold temperature refrigeration passage 140 having an inlet that receives, at the cold end of the heat exchanger, a cold temperature MR vapor stream 455 and a cold temperature MR liquid stream 475. The refrigeration passage 170 also includes a primary refrigeration passage 160 having a refrigerant return stream outlet at the warm end of the heat exchanger, through which the refrigerant return stream 610 exits the heat exchanger 100, and a middle temperature refrigerant inlet 150 adapted to receive a middle temperature MR vapor stream 355 and a middle temperature MR liquid stream 375 via corresponding passages. As a result, as explained in greater detail below, cold temperature MR vapor and liquid streams (455 and 475) and middle temperature MR vapor and liquid streams (355 and 375) combine within the heat exchanger at the middle temperature refrigerant inlet 150.

The combination of the middle temperature refrigerant streams and the cold temperature refrigerant stream forms a middle temperature zone or region in the heat exchanger generally from the point at which they combine and downstream from there in the direction of the refrigerant flow toward the primary refrigeration passage outlet.

A primary MR stream 610, which is vapor or mixed phase, exits the primary refrigeration passage 160 of the heat exchanger 100 and travels to the MR compressor system of any of FIGS. 1-6. As an example only, in the embodiments of FIGS. 1-3, 5 and 6, the primary MR stream 610 may be vapor. As the ambient temperature gets colder than design, the primary MR stream 610 will be mixed phase (vapor and liquid), and liquid will accumulate in the suction drum 600 (of FIGS. 1-3, 5 and 6). After the process becomes steady state at the lower temperature, the primary MR stream is again all vapor at dew point. When the day warms up, the liquid in the suction drum 600 will vaporize, and the primary MR stream will be all vapor. As a result, the mixed phase primary MR stream only occurs in transient conditions when the ambient temperature is getting colder than design. Alternatively, the system could be designed for a mixed phase primary MR stream 610.

The heat exchanger 100 also includes a high pressure vapor cooling passage 195 adapted to receive a high pressure MR vapor stream 955 from any of the MR compressor systems of FIGS. 1-6 at the warm end and to cool the high pressure MR vapor stream to form a mixed phase cold separator MR feed stream 210. Passage 195 also includes an outlet in communication with a cold vapor separator 200. The cold vapor separator 200 separates the cold separator feed stream 210 into a cold separator MR vapor stream 255 and a cold separator MR liquid stream 275.

The heat exchanger 100 also includes a cold separator vapor cooling passage 127 having an inlet in communication with the cold vapor separator 200 so as to receive the cold separator MR vapor stream 255. The cold separator MR vapor stream is cooled in passage 127 to form condensed cold temperature MR stream 410, which is flashed with expansion device 410E to form expanded cold temperature MR stream 420 which is directed to cold temperature standpipe 400. Expansion device 410E (and as in the case with all "expansion devices" disclosed herein) may be, as non-limiting examples, a valve (such as a Joule Thompson valve), a turbine or a restrictive orifice.

Cold temperature standpipe 400 separates the mixed-phase stream 420 into a cold temperature MR vapor stream 455 and a cold temperature MR liquid stream 475 which enter the inlet of the cold temperature refrigerant passage 140. The vapor and liquid streams 455 and 475 preferably enter the cold temperature refrigerant passage 140 via a header having separate entries for streams 455 and 475. This provides for more even distribution of liquid and vapor within the header.

The cold separator MR liquid stream 275 is cooled in cold separator liquid cooling passage 125 to form subcooled cold separator MR liquid stream 310.

A high pressure liquid cooling passage 197 receives high pressure MR liquid stream 975 from any of the MR compressor systems of FIG. 1-6. The high pressure liquid 975 is preferably a mid-boiling refrigerant liquid stream. The high pressure liquid stream enters the warm end and is cooled to form a subcooled high pressure MR liquid stream 330. Both refrigerant liquid streams 310 and 330 are independently flashed via expansion devices 310E and 330E to form expanded cold separator MR stream 320 and expanded high pressure MR stream 340. The expanded cold separator MR stream 320 is combined and equilibrated with the expanded high pressure MR stream 340 in mid-temperature standpipe 300 to form middle temperature MR vapor stream 355 and middle temperature MR liquid stream 375. In alternative embodiments, the two streams 310 and 330 may be mixed and then flashed.

The middle temperature MR streams 355 and 375 are directed to the middle temperature refrigerant inlet 150 of the refrigeration passage where they are mixed with the combined cold temperature MR vapor stream 455 and a cold temperature MR liquid stream 475 and provide refrigeration in the primary refrigeration passage 160. The refrigerant exits the primary refrigeration passage 160 as a vapor phase or mixed phase primary MR stream or refrigerant return stream 610. The return stream 610 may optionally be a superheated vapor refrigerant return stream.

Figure 9:
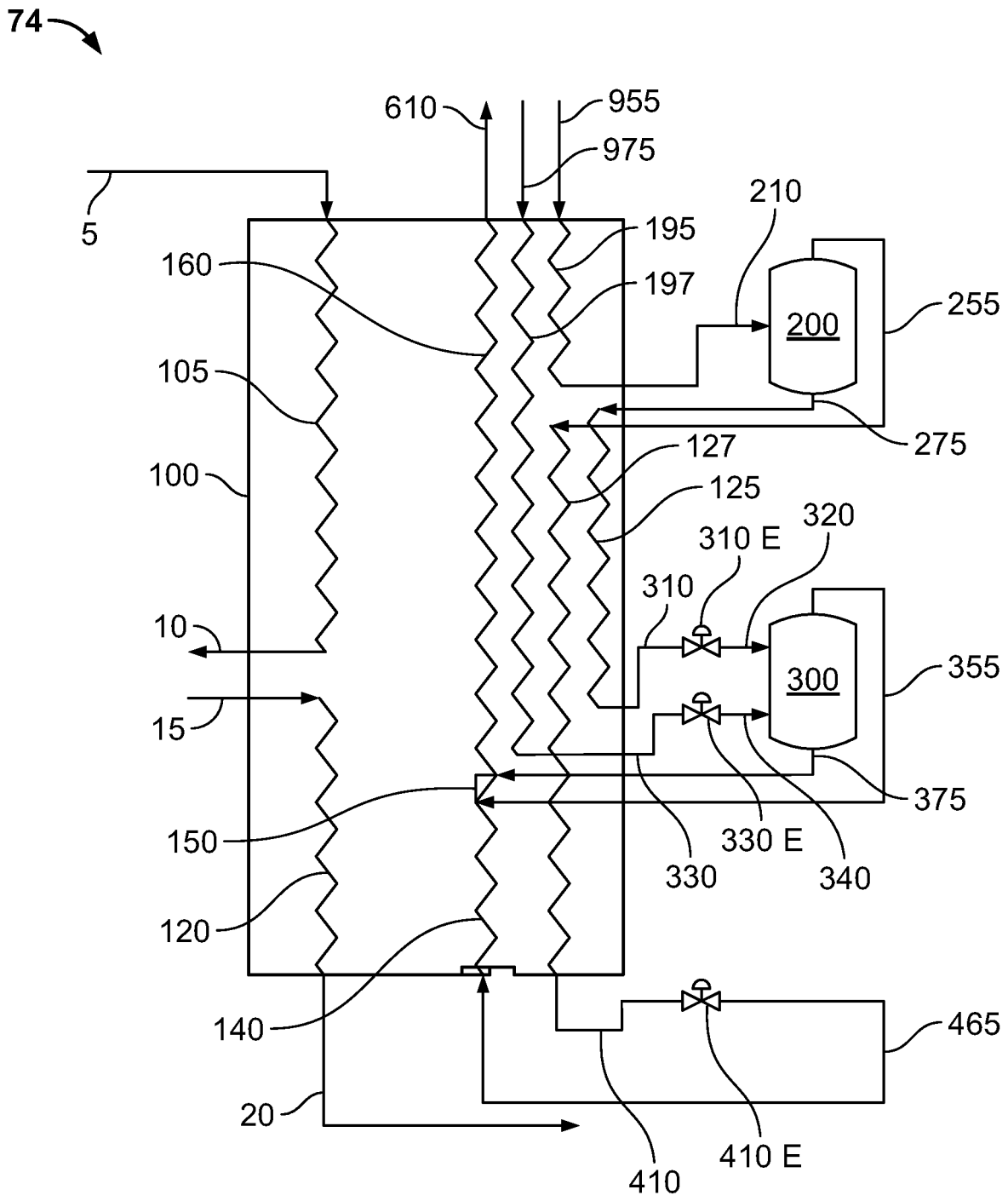
FIG. 9 is a process flow diagram and schematic illustrating a heat exchange system in an additional embodiment of the mixed refrigerant system and method of the disclosure.

An alternative embodiment of the heat exchange system, indicated in general at 74 in FIG. 9, provides an alternative embodiment of the cold temperature MR expansion loop. In this embodiment, the cold temperature standpipe 400 of FIGS. 7 and 8 is eliminated. As a result, the condensed cold temperature MR stream 410 from the cold separator vapor cooling passage 127 exits the cold end of the heat exchanger and is flashed with expansion device 410E to form cold temperature MR stream 465. Mixed phase stream 465 then enters the inlet of the cold temperature refrigerant passage 140. The remainder of the heat exchange system 74 is the same, and operates in the same manner, as heat exchanger system 70 of FIG. 7. The feed stream treatment outlet and inlet 10 and 15 (leading to and from a treatment system) may be omitted, in the manner shown for heat exchange system 72 of FIG. 8.

Figure 10:
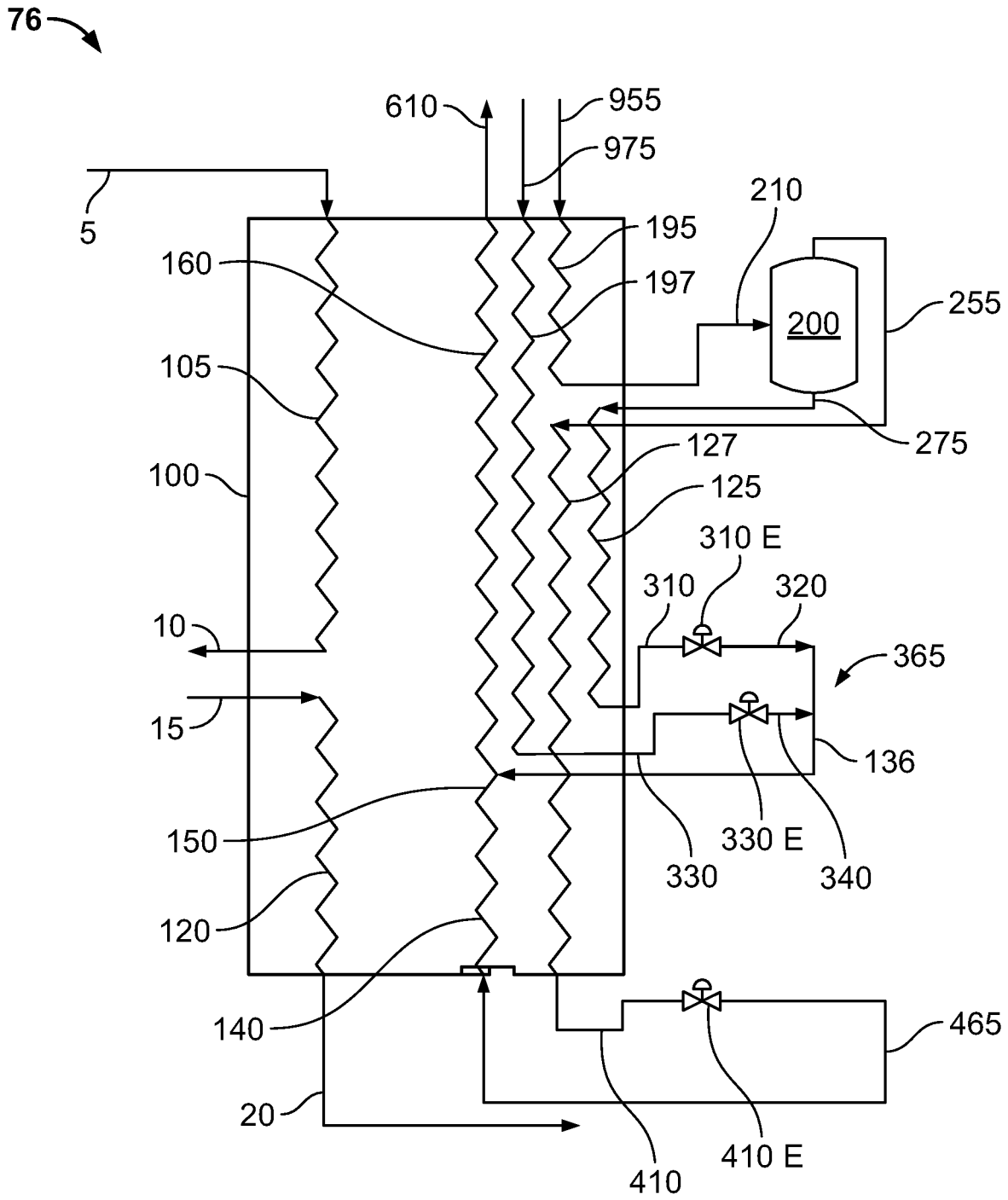
FIG. 10 is a process flow diagram and schematic illustrating a heat exchange system in an additional embodiment of the mixed refrigerant system and method of the disclosure.
Figure 11:
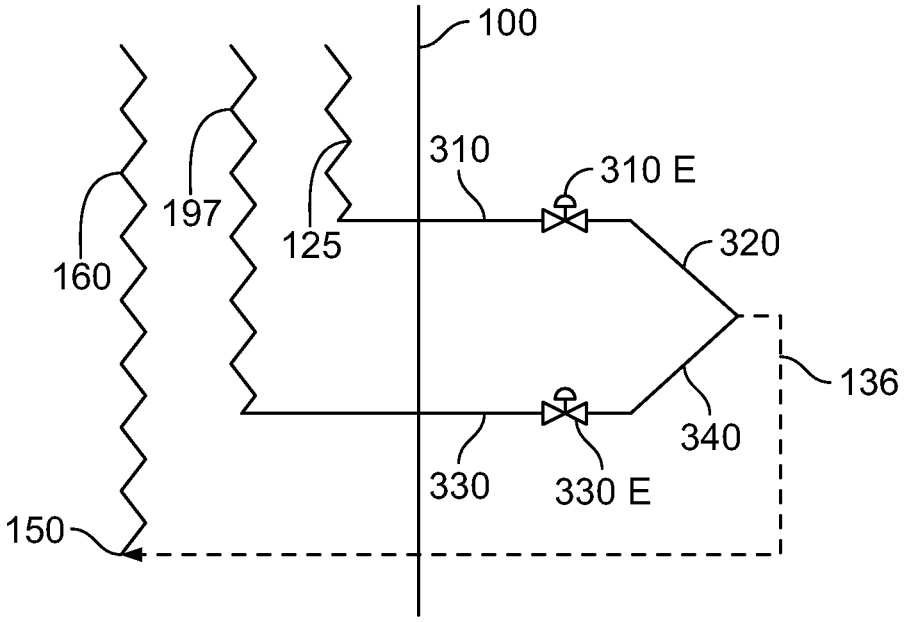
FIG. 11 is a process flow diagram and schematic illustrating a middle temperature portion of a heat exchange system in an additional embodiment of the mixed refrigerant system and method of the disclosure.

In another alternative embodiment of the heat exchange system, indicated in general at 76 in FIG. 10, the mid-temperature standpipe 300 of FIGS. 7-9 has been omitted. As a result, as illustrated in FIGS. 10 and 11, both refrigerant liquid streams 310 and 330 are independently flashed via expansion devices 310E and 330E to form expanded cold separator MR stream 320 and expanded high pressure MR stream 340 that are combined to form middle temperature MR stream 365 that flows through middle temperature refrigeration passage 136. Middle temperature MR stream 365 is directed via passage 136 to the middle temperature refrigerant inlet 150 of the refrigeration passage where it is mixed with the cold temperature MR stream 465 to provide refrigeration in the primary refrigeration passage 160. The remainder of the heat exchange system 76 is the same, and operates in the same manner, as heat exchanger system 74 of FIG. 9. The feed stream treatment outlet and inlet 10 and 15 (leading to and from a treatment system) may be omitted, in the manner shown for heat exchange system 72 of FIG. 8.

Figure 12:
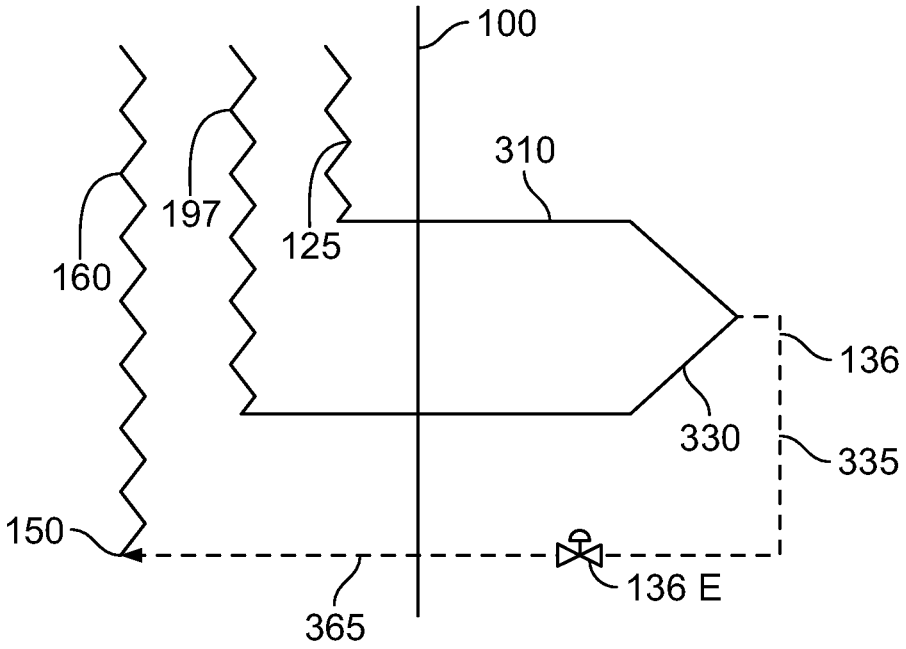
FIG. 12 is a process flow diagram and schematic illustrating a middle temperature portion of a heat exchange system in an additional embodiment of the mixed refrigerant system and method of the disclosure.

As illustrated in FIG. 12, the expansion devices 310E and 330E may be omitted from the passages of the subcooled cold separator MR stream 310 and subcooled high pressure MR stream 330 so that the two streams combine to form stream 335. In this embodiment, an expansion device 136E is placed within the middle temperature refrigeration passage 136 so that stream 335 is flashed to form the middle temperature MR stream 365. Middle temperature MR stream 365, which is mixed phase, is provided to the middle temperature refrigerant inlet 150.

Figure 13:
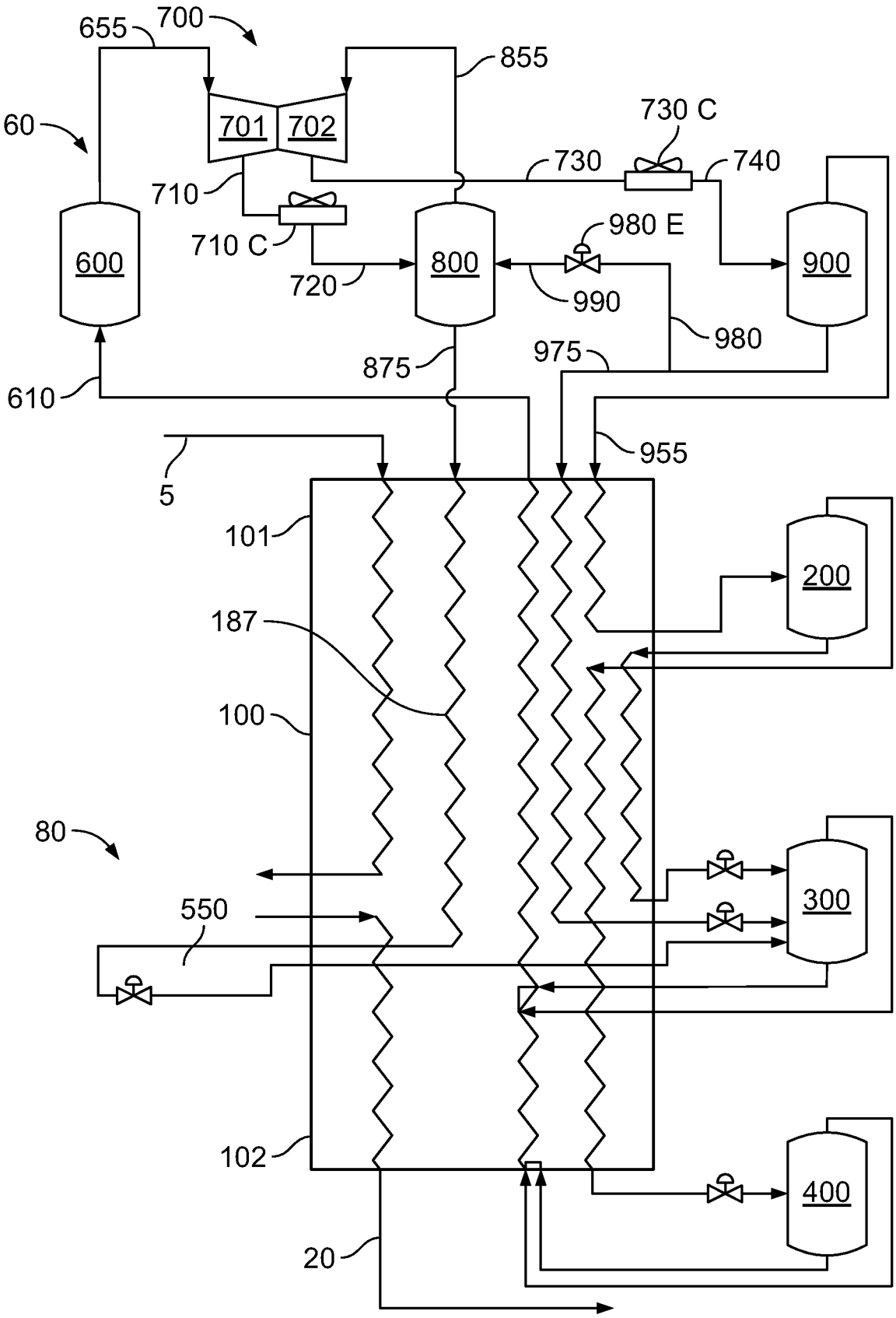
FIG. 13 is a process flow diagram and schematic illustrating an additional embodiment of the mixed refrigerant system and method of the disclosure.

A further alternative embodiment of a mixed refrigerant system and method is illustrated in FIG. 13. The system includes an MR compressor system, indicated in general at 60, and a heat exchange system, indicated in general at 80. The embodiment of FIG. 13 is the same, and has the same functionality, as the embodiment of FIG. 1 with the exception of the details described below. As a result, the same reference numbers will be repeated for the corresponding components.

The compressor first section 701 includes a compressed fluid outlet for providing a compressed suction drum MR vapor stream 710 to first section cooler 710C so that cooled compressed suction drum MR stream 720 is provided to interstage drum 800. The stream 720 travels to the interstage drum 800 and the resulting low pressure MR vapor stream 855 is provided to the compressor second section 702. The compressor second section 702 provides a compressed high pressure MR vapor stream 730 to the second section cooler 730C. As a result, a high pressure MR stream 740 that is at least partially condensed travels to high pressure separation device 900.

The high pressure separation device 900 separates the MR stream 740 into a high pressure MR vapor stream 955 and a high pressure MR liquid stream 975, which is preferably a mid-boiling refrigerant liquid stream. A high pressure MR recycle liquid stream 980 branches off of stream 975 and is provided to an expansion device 980E so that a high pressure MR recycle mixed phase stream 990 is provided to interstage drum 800. This keeps the interstage drum 800 from running dry during warm ambient temperatures (i.e. such as on a hot day). As described previously (with respect to FIG. 3) and below, the recycle stream 980 could instead run directly from the high pressure separation device 900 to the expansion device 980E.

In contrast to the MR compressor system embodiments described above, the interstage drum 800 of MR compressor system 60 includes a liquid outlet for providing a low pressure MR liquid stream 875 that has a high boiling temperature. The low pressure MR liquid stream 875 is received by a low pressure liquid cooling passage 187 of the heat exchanger 100 and is further handled as described below.

Figure 14:
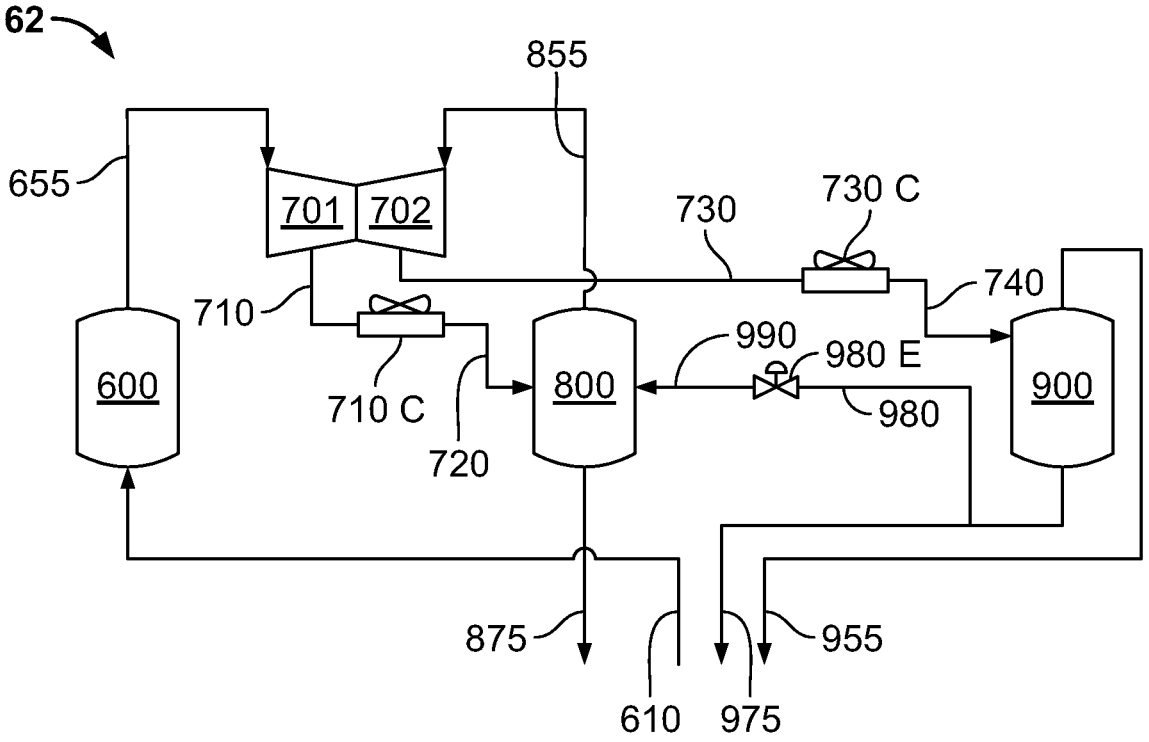
FIG. 14 is a process flow diagram and schematic illustrating a mixed refrigerant compressor system in an additional embodiment of the mixed refrigerant system of the disclosure.

An alternative embodiment of the MR compressor system is indicated in general at 62 of FIG. 14, and also includes an interstage drum 800 having a liquid outlet that provides a low pressure MR liquid stream 875.

Figure 15:
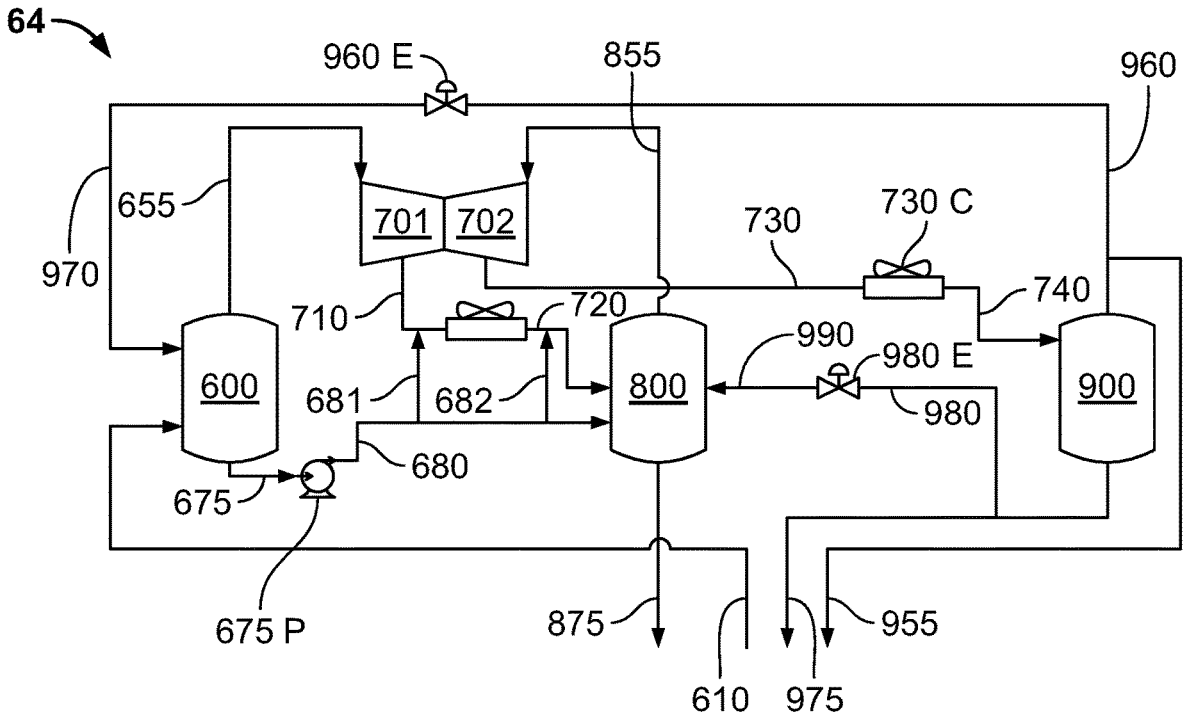
FIG. 15 is a process flow diagram and schematic illustrating a mixed refrigerant compressor system in an additional embodiment of the mixed refrigerant system and method of the disclosure.

In another alternative embodiment of the MR compressor system, indicated in general at 64 in FIG. 15, a mixed phase primary MR stream 610 is returned from the heat exchanger of FIG. 13 to the suction separation device 600. The suction separation device 600 has a liquid outlet through which a suction drum MR liquid stream 675 exits the drum. The stream 675 travels to a suction drum pump 675P, which produces suction drum MR stream 680, which travels to interstage drum 800. Optional branch suction drum MR streams 681 and 682 may flow to the compressed suction drum MR vapor stream 710 and/or the cooled compressed suction drum MR stream 720.

Otherwise, the MR compressor system 64 of FIG. 15 is the same, and functions the same, as MR compressor system 60 of FIG. 13.

Figure 16:
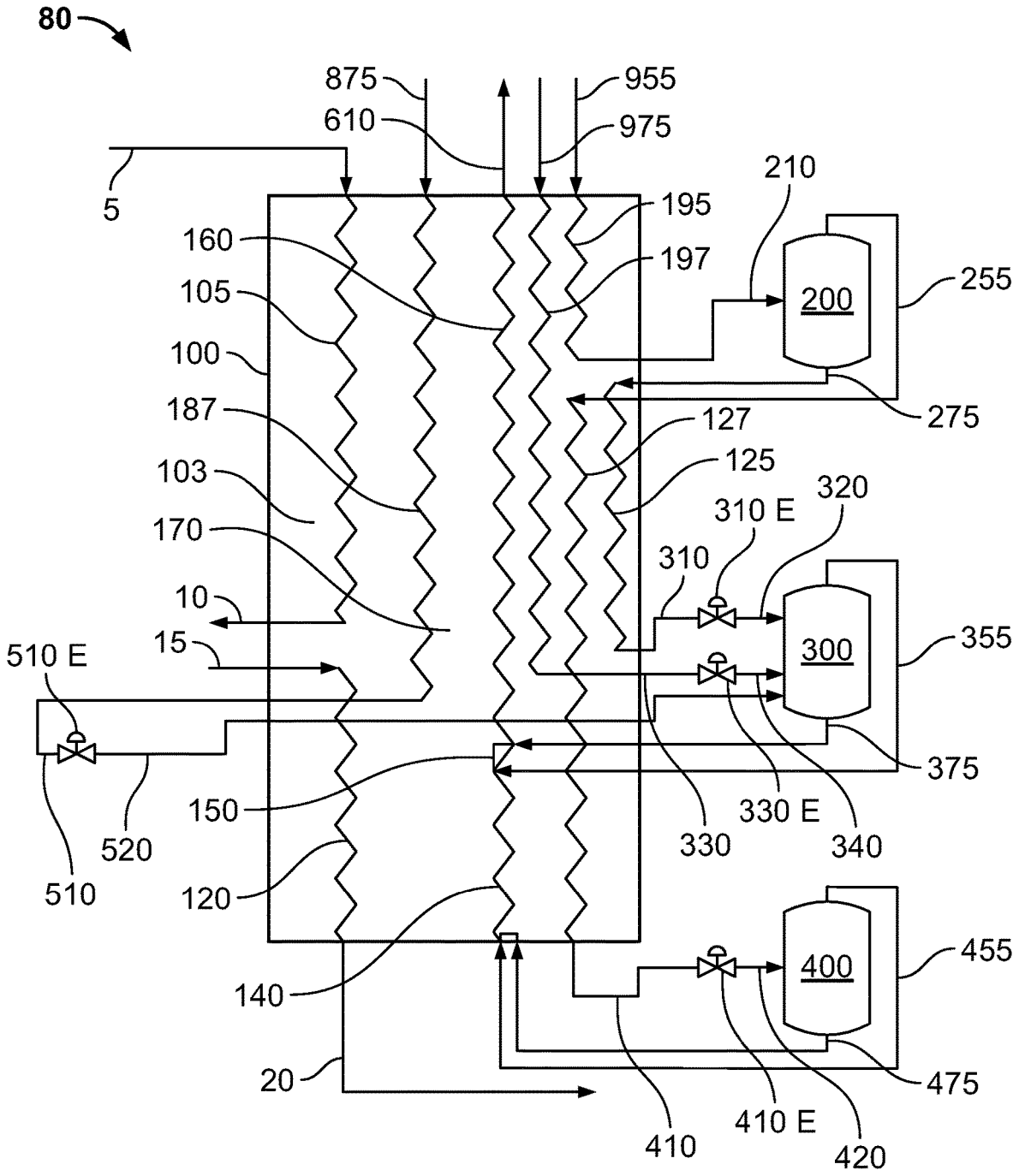
FIG. 16 is a process flow diagram and schematic illustrating a heat exchange system in an additional embodiment of the mixed refrigerant system and method of the disclosure.

The heat exchange system 80 of FIGS. 13 and 16 may be used with each of the MR compressor systems 60, 62 and 64 of FIGS. 13, 14 and 15 (and alternative MR compressor system embodiments). The heat exchange system 80 and will now be discussed in detail with reference to FIG. 16.

As illustrated in FIG. 16, and noted previously, the multi-stream heat exchanger 100 receives a feed fluid stream, such as a high pressure natural gas feed stream 5, that is cooled and/or liquefied in feed stream cooling passage 103 via removal of heat via heat exchange with refrigeration streams in the heat exchanger. As a result, a stream of product fluid 20 such as liquid natural gas, is produced.

As in the case of the heat exchange system 70 of FIG. 7, the feed stream cooling passage 103 of heat exchange system 80 includes a pre-treatment feed stream cooling passage 105, having an inlet at the warm end of heat exchanger 100, and a treated feed stream cooling passage 120 having a product outlet at the cold end through which product 20 exits. The pre-treatment feed stream cooling passage 105 has an outlet that joins feed fluid outlet 10 while treated feed stream cooling passage 120 has an inlet in communication with feed fluid inlet 15. Feed fluid outlet and inlet 10 and 15 are provided for external feed treatment (125 in FIGS. 1 and 3), such as natural gas liquids recovery, freezing component removal or nitrogen rejection, or the like.

Figure 17:
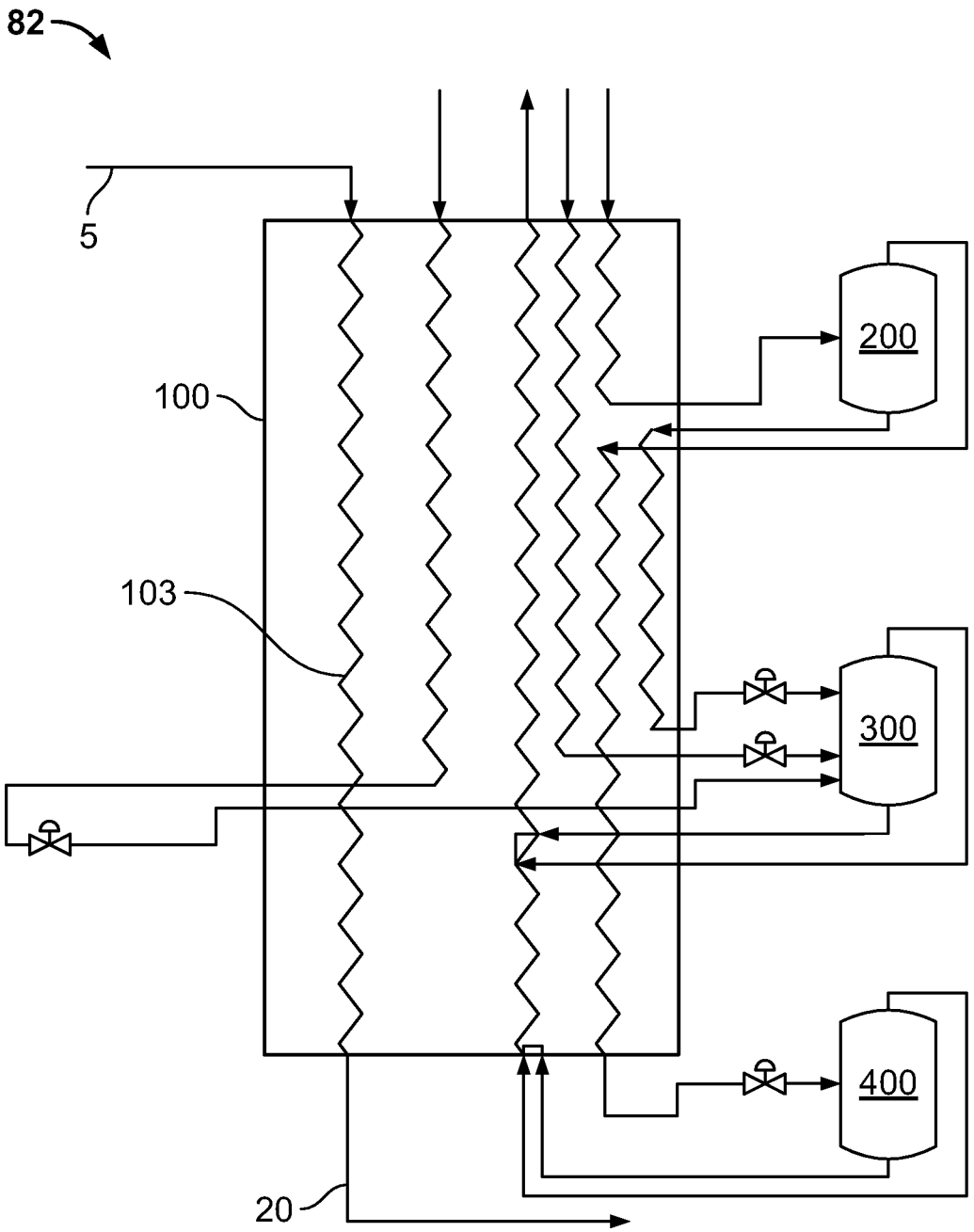
FIG. 17 is a process flow diagram and schematic illustrating a heat exchange system in an additional embodiment of the mixed refrigerant system and method of the disclosure.

In an alternative embodiment of the heat exchange system, indicated in general at 82 in FIG. 17, the feed stream cooling passage 103 passes between the warm and cold ends of the heat exchanger 100 without interruption. Such an embodiment may be used when external feed treatment systems are not heat integrated with the heat exchanger 100.

As in the case of the heat exchange system 70 of FIG. 7, the heat exchanger 100 includes a refrigeration passage, indicated in general at 170 in FIG. 16, that includes a cold temperature refrigeration passage 140 having an inlet that receives, at the cold end of the heat exchanger, a cold temperature MR vapor stream 455 and a cold temperature MR liquid stream 475. The refrigeration passage 170 also includes a primary refrigeration passage 160 having a refrigerant return stream outlet at the warm end of the heat exchanger, through which the refrigerant return stream 610 exits the heat exchanger 100, and a middle temperature refrigerant inlet 150 adapted to receive a middle temperature MR vapor stream 355 and a middle temperature MR liquid stream 375 via corresponding passages. As a result, cold temperature MR vapor and liquid streams (455 and 475) and middle temperature MR vapor and liquid streams (355 and 375) combine within the heat exchanger at the middle temperature refrigerant inlet 150.

The combination of the middle temperature refrigerant streams and the cold temperature refrigerant stream forms a middle temperature zone or region in the heat exchanger generally from the point at which they combine and downstream from there in the direction of the refrigerant flow toward the primary refrigeration passage outlet.

A primary MR stream 610 exits the primary refrigeration passage 160 of the heat exchanger 100, travels to the MR compressor system of any of FIGS. 13-15 and is in the vapor phase or mixed phase. As an example only, in the embodiments of FIGS. 13 and 14, the primary MR stream 610 may be vapor. As the ambient temperature gets colder than design, the primary MR stream 610 will be mixed phase (vapor and liquid), and liquid will accumulate in the suction drum 600 (of FIGS. 13-15). After the process becomes steady state at the lower temperature, the primary MR stream is again all vapor at dew point. When the day warms up, the liquid in the suction drum 600 will vaporize, and the primary MR stream will be all vapor. As a result, the mixed phase primary MR stream only occurs in transient conditions when the ambient temperature is getting colder than design. Alternatively, the system could be designed for a mixed phase primary MR stream 610.

The heat exchanger 100 also includes a high pressure vapor cooling passage 195 adapted to receive a high pressure MR vapor stream 955 from any of the MR compressor systems of FIGS. 13-15 at the warm end and to cool the high pressure MR vapor stream to form a mixed phase cold separator MR feed stream 210. Passage 195 includes an outlet in communication with a cold vapor separator 200, which separates the cold separator feed stream 210 into a cold separator MR vapor stream 255 and a cold separator MR liquid stream 275.

The heat exchanger 100 also includes a cold separator vapor cooling passage 127 having an inlet in communication with the vapor outlet of the cold vapor separator 200 so as to receive the cold separator MR vapor stream 255. The cold separator MR vapor stream is cooled in passage 127 to form condensed cold temperature MR stream 410, and then flashed with expansion device 410E to form expanded cold temperature MR stream 420 which is directed to cold temperature standpipe 400. Expansion device 410E (and as in the case with all "expansion devices" disclosed herein) may be, as non-limiting examples, a Joule Thompson valve, a turbine or an orifice.

Cold temperature standpipe 400 separates the mixed-phase stream 420 into a cold temperature MR vapor stream 455 and a cold temperature MR liquid stream 475 which enter the inlet of the cold temperature refrigerant passage 140.

The cold separator MR liquid stream 275 is cooled in cold separator liquid cooling passage 125 to form subcooled cold separator MR liquid stream 310.

A high pressure liquid cooling passage 197 receives high pressure MR liquid stream 975 from any of the MR compressor systems of FIG. 13-15. The high pressure liquid 975 is preferably a mid-boiling refrigerant liquid stream. The high pressure liquid stream enters the warm end and is cooled to form a subcooled high pressure MR liquid stream 330. Both refrigerant liquid streams 310 and 330 are independently flashed via expansion devices 310E and 330E to form expanded cold separator MR stream 320 and expanded high pressure MR stream 340. The expanded cold separator MR stream 320 is combined with the expanded high pressure MR stream 340 in mid-temperature standpipe 300 to form middle temperature MR vapor stream 355 and middle temperature MR liquid stream 375. In alternative embodiments, the two streams 310 and 330 may be mixed and then flashed.

The middle temperature MR streams 355 and 375 are directed to the middle temperature refrigerant inlet 150 of the refrigeration passage where they are mixed with the combined cold temperature MR vapor stream 455 and a cold temperature MR liquid stream 475 and provide refrigeration in the primary refrigeration passage 160. The refrigerant exits the primary refrigeration passage 160 as a vapor phase or mixed phase primary MR stream or refrigerant return stream 610. The return stream 610 may optionally be a superheated vapor refrigerant return stream.

The heat exchanger 100 also includes a low pressure liquid cooling passage 187 that, as noted above, receives a low pressure MR liquid stream 875, that preferably is high-boiling refrigerant, from the liquid outlet of the interstage separation device or drum 800 of any of the MR compressor systems of FIGS. 13-15. The high-boiling MR liquid stream 875 is cooled in low pressure liquid cooling passage 187 to form a subcooled low pressure MR stream, which exits the heat exchanger as stream 510. The subcooled low pressure MR liquid stream 510 is then flashed or has its pressure reduced at expansion device 510E to form the expanded low pressure MR stream 520. As examples only, stream 510 may have a pressure of 200 psig and a temperature of −130° F., while stream 520 may have a pressure of 50 psig and a temperature of −130° F. Stream 520 is directed to the mid-temperature standpipe 300, as illustrated in FIG. 16, where it is combined with expanded cold separator MR stream 320 and expanded high pressure MR stream 340. As a result, high-boiling refrigerant is provided to the middle temperature refrigerant inlet 150, and thus to the primary refrigeration passage 160.

Figure 18:
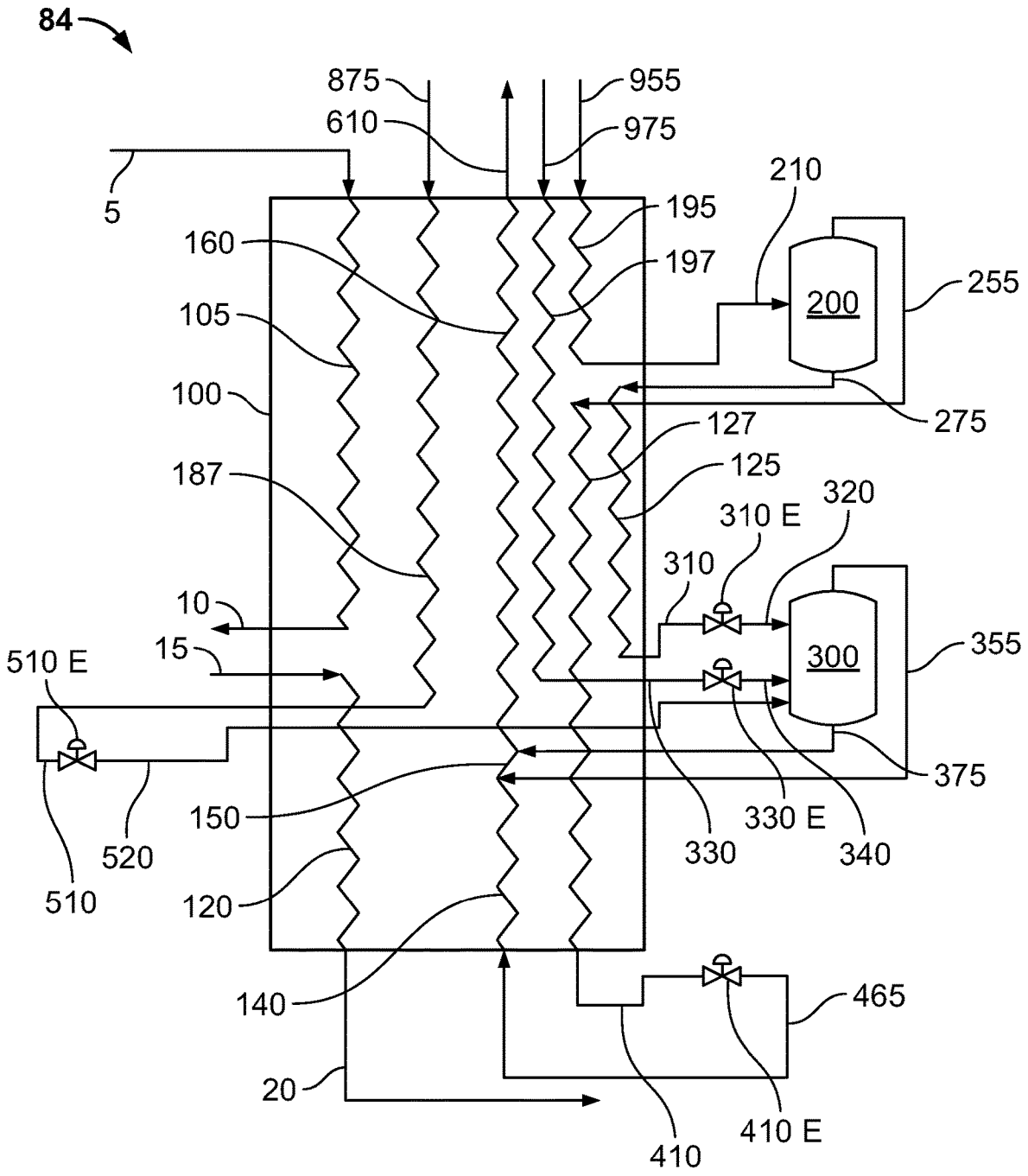
FIG. 18 is a process flow diagram and schematic illustrating a heat exchange system in an additional embodiment of the mixed refrigerant system and method of the disclosure.

An alternative embodiment of the heat exchange system is indicated in general at 84 in FIG. 18 and provides an alternative embodiment of the cold temperature MR expansion loop. More specifically, in this embodiment, the cold temperature standpipe 400 of FIGS. 13, 16 and 17 is eliminated. As a result, the condensed cold temperature MR stream 410 from the cold separator vapor cooling passage 127 exits the cold end of the heat exchanger and is flashed with expansion device 410E to form cold temperature MR stream 465. Mixed phase stream 465 then enters the inlet of the cold temperature refrigerant passage 140. The remainder of the heat exchange system 84 is the same, and operates in the same manner, as heat exchanger system 80 of FIG. 16. The feed stream treatment outlet and inlet 10 and 15 (leading to and from a treatment system) may be omitted, in the manner shown for heat exchange system 82 of FIG. 17.

Figure 19:
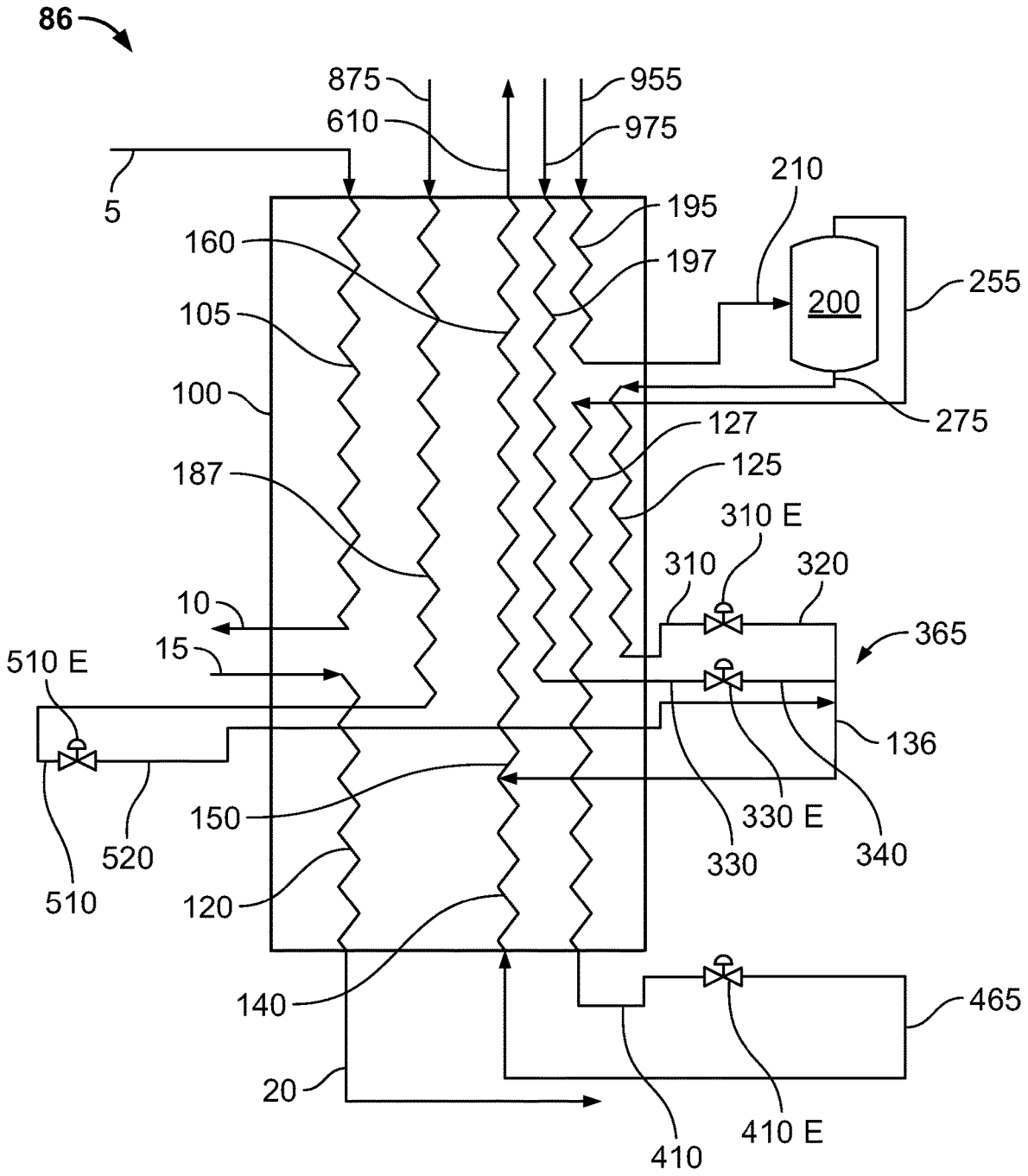
FIG. 19 is a process flow diagram and schematic illustrating a heat exchange system in an additional embodiment of the mixed refrigerant system and method of the disclosure
Figure 20:
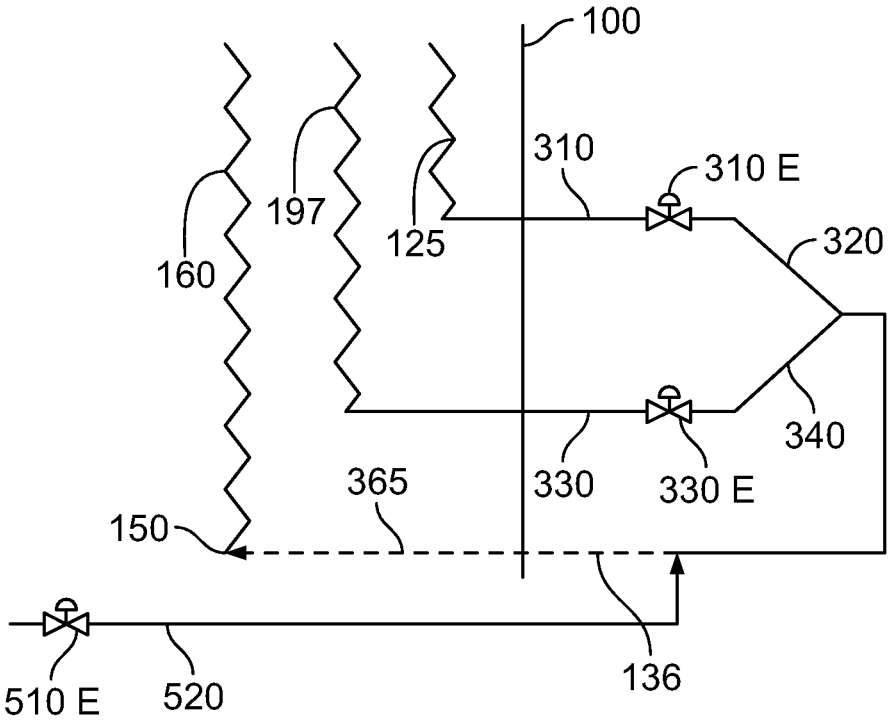
FIG. 20 is a process flow diagram and schematic illustrating a middle temperature portion of a heat exchange system in an additional embodiment of the mixed refrigerant system and method of the disclosure.

In another alternative embodiment of the heat exchange system, indicated in general at 86 in FIG. 19, the mid-temperature standpipe 300 of FIGS. 16-18 has been omitted. As a result, as illustrated in FIGS. 19 and 20, both refrigerant liquid streams 310 and 330 are independently flashed via expansion devices 310E and 330E to form expanded cold separator MR stream 320 and expanded high pressure MR stream 340. These two streams are combined with expanded low pressure MR stream 520 to form middle temperature MR stream 365 that flows through middle temperature refrigeration passage 136. Middle temperature MR stream 365 is directed via passage 136 to the middle temperature refrigerant inlet 150 of the refrigeration passage where it is mixed with the cold temperature MR stream 465 to provide refrigeration in the primary refrigeration passage 160. The remainder of the heat exchange system 86 is the same, and operates in the same manner, as heat exchanger system 84 of FIG. 18. The feed stream treatment outlet and inlet 10 and 15 (leading to and from a treatment system) may be omitted, in the manner shown for heat exchange system 82 of FIG. 17.

Figure 21:
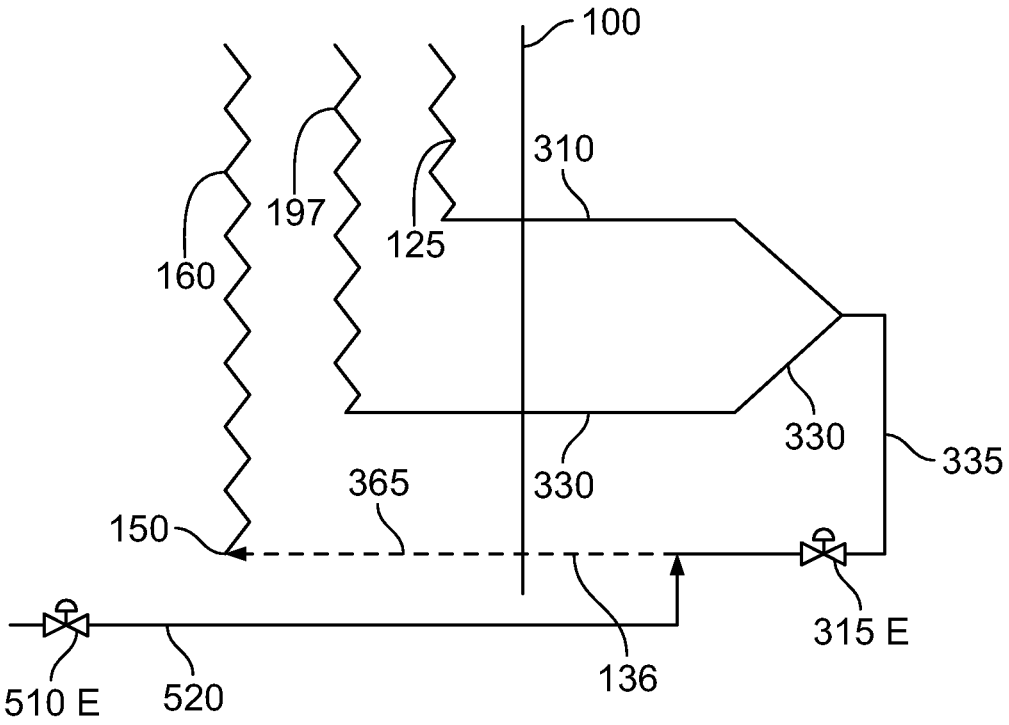
FIG. 21 is a process flow diagram and schematic illustrating a middle temperature portion of a heat exchange system in an additional embodiment of the mixed refrigerant system and method of the disclosure.

As illustrated in FIG. 21, the expansion devices 310E and 330E may be omitted from the passages of the subcooled cold separator MR stream 310 and subcooled high pressure MR stream 330. In this embodiment, an expansion device 315E is placed downstream of the junction of streams 310 and 330, but upstream of the junction with stream 520. As a result, the stream 335 consisting of combined streams of 310 and 330 is flashed and then mixed with stream 520 so that middle temperature MR stream 365, which is mixed phase, is provided to the middle temperature refrigerant inlet 150 via passage 136.

In alternative embodiments, the expansion device 510E of FIGS. 20 and 21 may be omitted so that subcooled low pressure MR stream 510 is provided (instead of stream 520) to mix with stream 335 after expansion via expansion device 315E to form stream 365.

Figure 22:
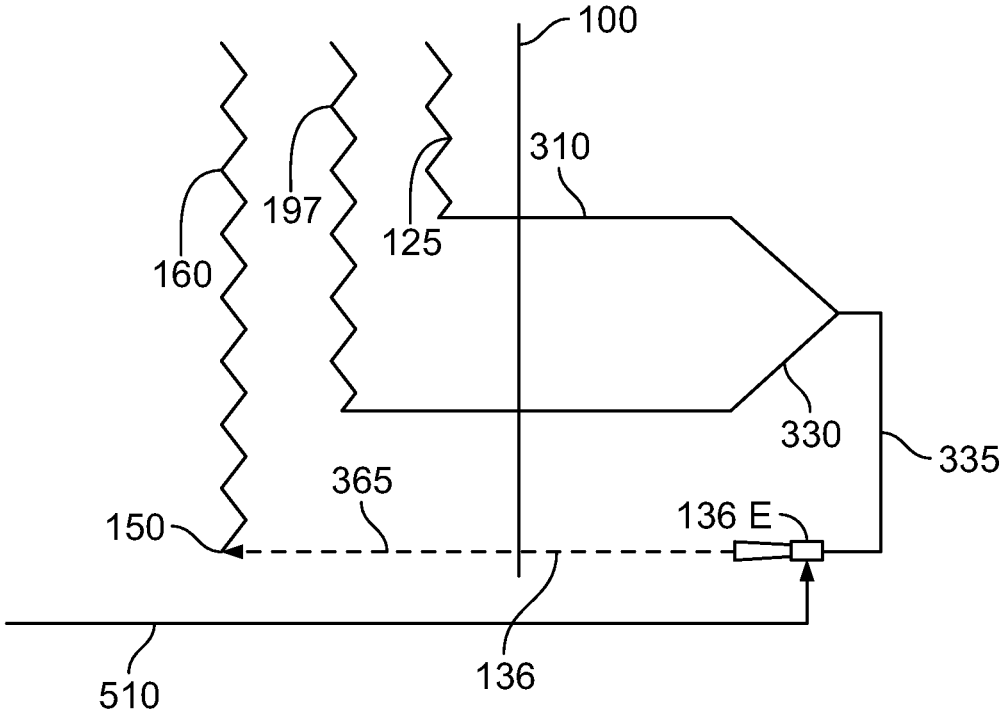
FIG. 22 is a process flow diagram and schematic illustrating a middle temperature portion of a heat exchange system in an additional embodiment of the mixed refrigerant system and method of the disclosure.

In another alternative embodiment illustrated in FIG. 22, stream 335 and stream 510 may be directed to a combined mixing and expansion device 136E. The device 136E, as an example only, could have multiple inlets and separate liquid and vapor outlets. As another example, two liquid expanders in series, with the stream 510 fed in between, could be used.

In each of the above embodiments, one or more of an external treatment, pre-treatment, post-treatment, integrated treatment, or combination thereof may independently be in communication with the feed stream cooling passage and adapted to treat the feed stream, product stream, or both.

As an example, and noted previously with reference to FIGS. 7 and 16, the feed stream cooling passage 103 of the heat exchanger 100 includes a pre-treatment feed stream cooling passage 105, having an inlet at the warm end of heat exchanger 100, and a treated feed stream cooling passage 120 having a product outlet at the cold end through which product 20 exits. The pre-treatment feed stream cooling passage 105 has an outlet that joins feed fluid outlet 10 while treated feed stream cooling passage 120 has an inlet in communication with feed fluid inlet 15. Feed fluid outlet and inlet 10 and 15 are provided for external feed treatment (125 in FIGS. 1 and 3), such as natural gas liquids recovery, freezing component removal or nitrogen rejection, or the like.

Figure 23:
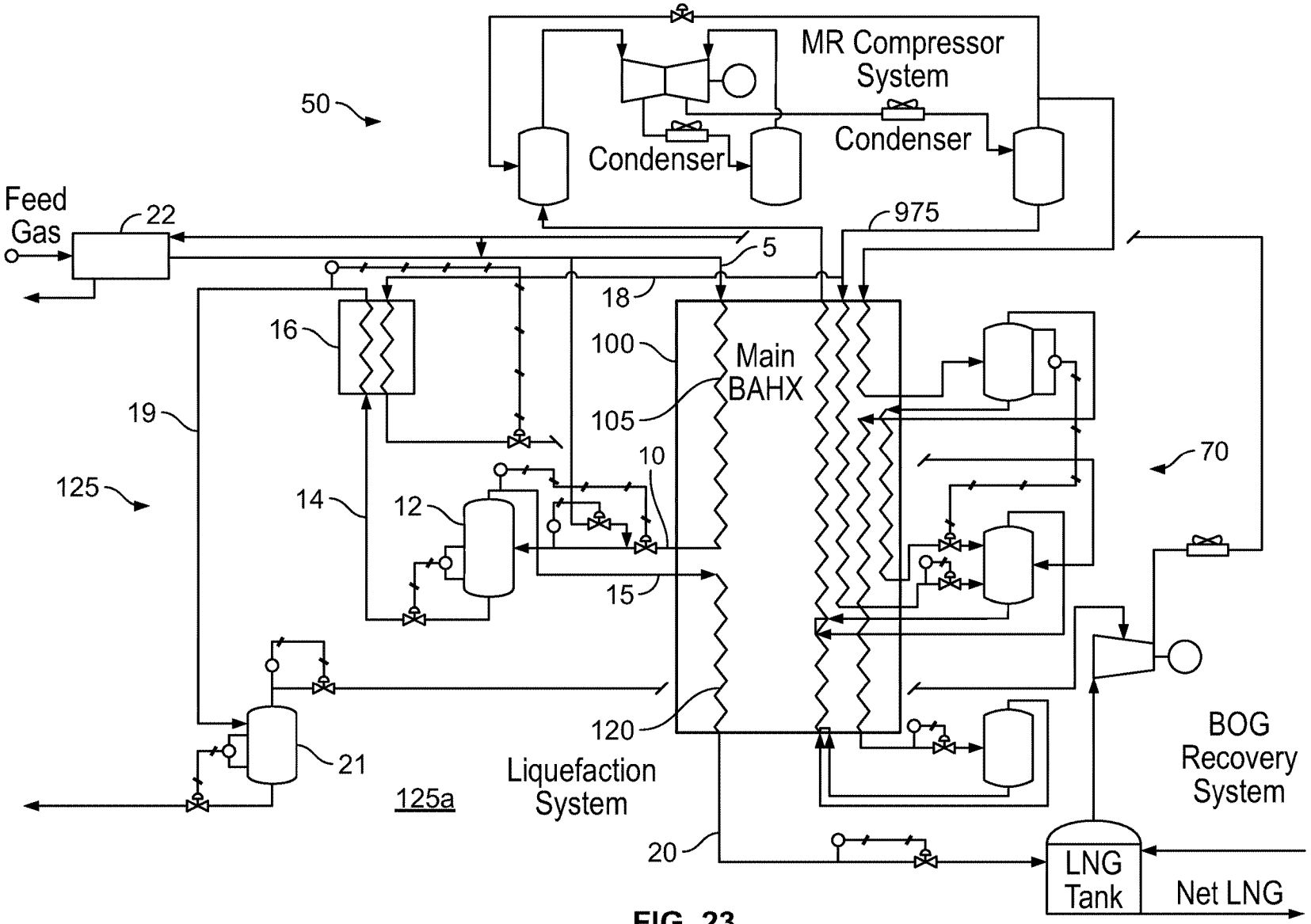
FIG. 23 is a process flow diagram and schematic illustrating an additional embodiment of the mixed refrigerant system and method of the disclosure including a feed treatment system.

An example of a system for external feed treatment, as used with MR compressor system 50 and heat exchange system 70, is indicated in general at 125 in FIG. 23. As illustrated in FIG. 23, the feed fluid outlet 10 directs mixed-phased feed fluid to a heavies knock out drum 12 (or other separation device). The drum 12 includes a vapor outlet which is in communication with feed stream communication inlet 15 so that vapor from the separation device 12 travels to the treated feed stream cooling passage 120 of the heat exchanger. The separation device 12 also includes a liquid outlet through which a liquid stream 14 flows to heat exchanger 16, where it is heated by heat exchange with a refrigerant stream 18 provided by a branch off of the high pressure MR liquid stream 975 of the MR compressor system 50. The resulting heated liquid 19 flows to a condensate stripping column 21 for further processing.

Figure 24:
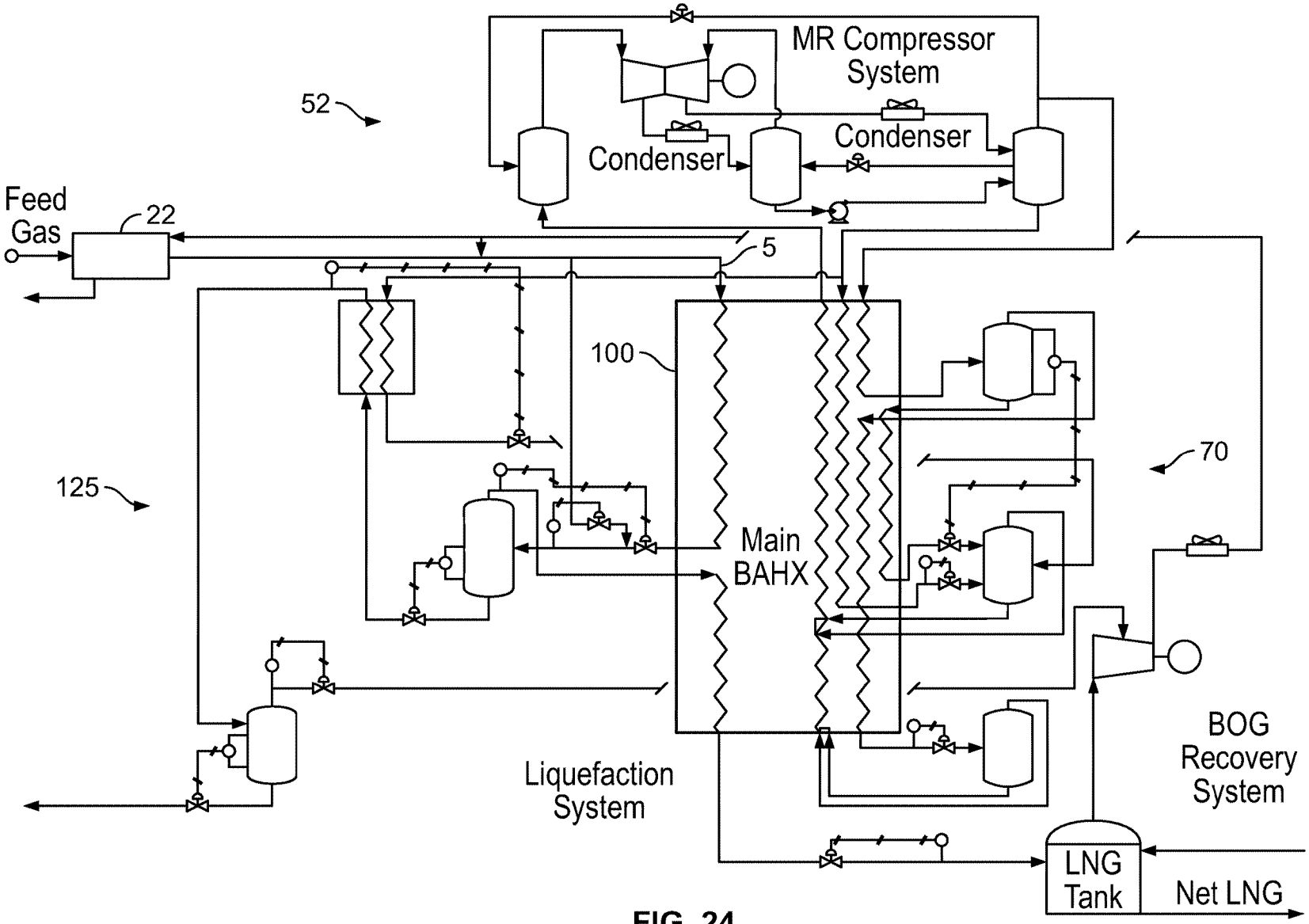
FIG. 24 is a process flow diagram and schematic illustrating an additional embodiment of the mixed refrigerant system and method of the disclosure including a feed treatment system.
Figure 25:
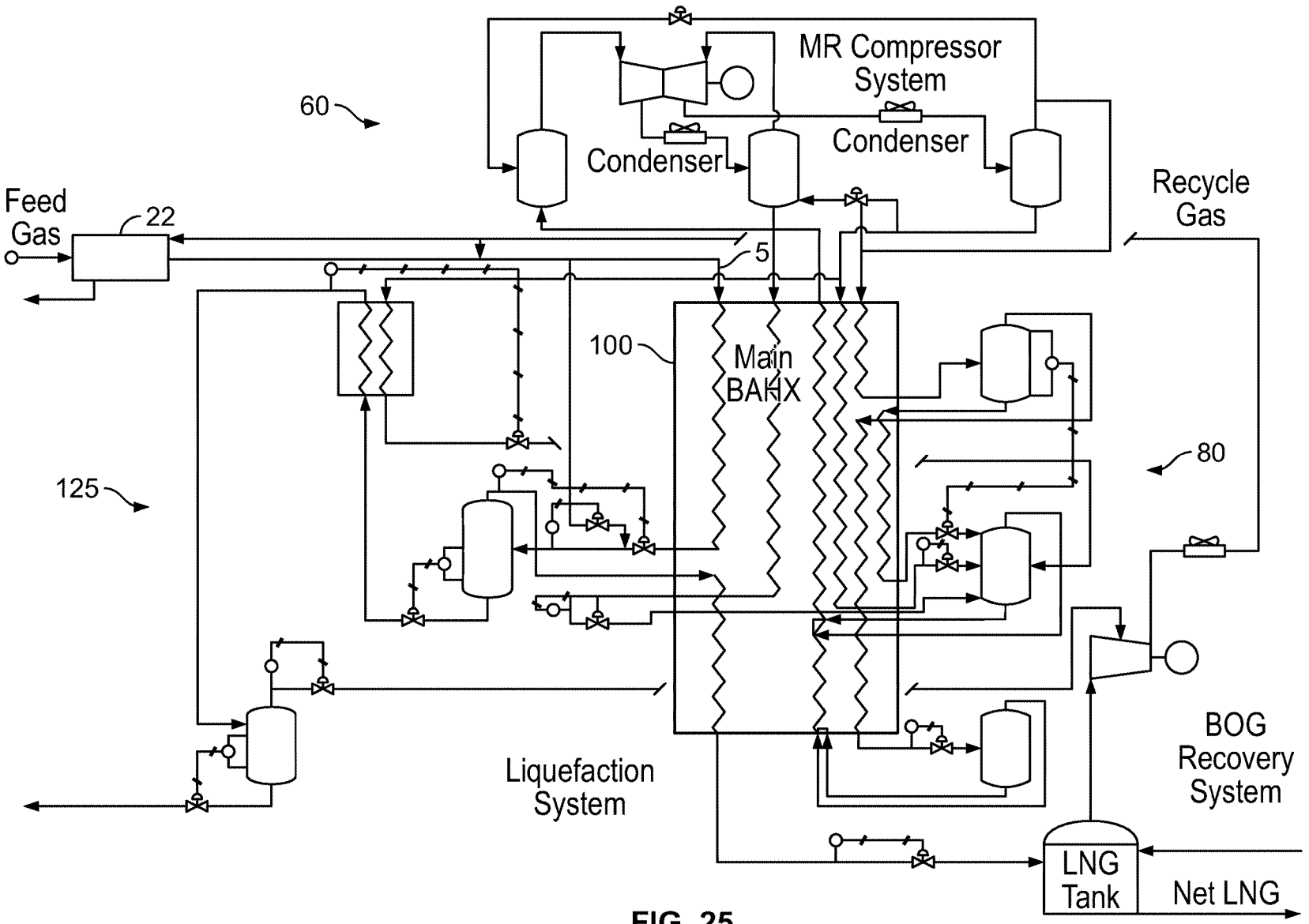
FIG. 25 is a process flow diagram and schematic illustrating an additional embodiment of the mixed refrigerant system and method of the disclosure including a feed treatment system.

The external feed treatment 125 may also be combined with any of the MR compressor system and heat exchange system embodiments described above, including MR compressor system 52 and heat exchange system 70, as illustrated in FIG. 24, and MR compressor system 60 and heat exchange system 80, as illustrated in FIG. 25.

As illustrated at 22 in FIGS. 23-25, the feed gas may be subjected to pre-treatment via a pre-treatment system 22 prior to entering the heat exchanger 100 as stream 5.

Each of the external treatment, pre-treatment, or post-treatment, may independently include one or more of removing one or more of sulfur, water, $CO_2$, natural gas liquid (NGL), freezing component, ethane, olefin, C6 hydrocarbon, C6+ hydrocarbon, $N_2$, or combination thereof, from the feed stream.

Furthermore, one or more pre-treatment may independently include one or more of desulfurizing, dewatering, removing $CO_2$, removing one or more natural gas liquids (NGL), or a combination thereof in communication with the feed stream cooling passage and adapted to treat the feed stream, product stream, or both.

In addition, one or more external treatment may independently include one or more of removing one or more natural gas liquids (NGL), removing one or more freezing components, removing ethane, removing one or more olefins, removing one or more C6 hydrocarbons, removing one or more C6+ hydrocarbons, in communication with the feed stream cooling passage and adapted to treat the feed stream, product stream, or both.

Each of the above embodiments may also be provided with one or more post-treatments which may include removing $N_2$ from the product and be in communication with the feed stream cooling passage and adapted to treat the feed stream, product stream, or both.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for cooling a gas with a mixed refrigerant comprising:

a. a main heat exchanger including a warm end and a cold end with a feed stream cooling passage extending therebetween, the feed stream cooling passage being adapted to receive a feed stream at the warm end and to convey a cooled product stream out of the cold end, said main heat exchanger also including a high pressure vapor cooling passage, a high pressure liquid cooling passage, a cold separator vapor cooling passage, a cold separator liquid cooling passage and a refrigeration passage;

b. a mixed refrigerant compressor system including a compressor first section having a compressor first section inlet in fluid communication with a refrigeration passage outlet of the refrigeration passage, said compressor first section also having a compressor first section outlet, a first section cooler having a first section cooler inlet in fluid communication with the compressor first section outlet said first section cooler also having a first section cooler outlet, an interstage separation device having a main interstage separation device inlet in fluid communication with the first section cooler outlet, said interstage separation device having an interstage separation device vapor outlet, a compressor second section having a compressor second section inlet in fluid communication with the interstage separation device vapor outlet, said compressor second section also having a compressor second section outlet, a second section cooler having a second section cooler inlet in fluid communication with the compressor second section outlet, said second section cooler also having a second section cooler outlet, a high pressure separation device having a high pressure separation device inlet in fluid communication with the second section cooler outlet, said high pressure separation device also having a high pressure separation device liquid outlet and a high pressure separation device vapor outlet, wherein the interstage separation device has a recycle fluid inlet that is separate and distinct from the main interstage separation device inlet and further comprising a high pressure recycle expansion device having an inlet in fluid communication with the high pressure separation device and an outlet in fluid communication with the recycle fluid inlet of the interstage separation device and configured so that a recycle mixed phase stream is provided to the interstage separation device through the recycle fluid inlet and mixed with fluid entering the interstage separation device through the main interstage separation device inlet so that an interstage pump is kept running when insufficient liquid is provided by fluid entry solely through the main interstage separation device inlet;

c. said high pressure vapor cooling passage of the heat exchanger having an inlet in fluid communication with the vapor outlet of the high pressure separation device;

d. a cold vapor separator having an inlet in fluid communication with an outlet of the high pressure vapor cooling passage, said cold vapor separator having a liquid outlet and a vapor outlet;

e. said cold separator liquid cooling passage of the heat exchanger having an inlet in fluid communication with the liquid outlet of the cold vapor separator and an outlet in fluid communication with the refrigeration passage;

f. said high pressure liquid cooling passage of the heat exchanger having an inlet in fluid communication with the high pressure separation device liquid outlet and an outlet in fluid communication with the refrigeration passage, wherein the high pressure liquid cooling passage is separate and distinct from the cold separator liquid cooling passage so that the high pressure liquid cooling passage and the cold separator liquid cooling passage are configured to subcool a high pressure liquid stream and a cold separator liquid stream, respectively, prior to combination of the subcooled high pressure liquid stream and the subcooled cold separator liquid stream;

g. said cold separator vapor cooling passage of the heat exchanger having an inlet in fluid communication with the vapor outlet of the cold vapor separator; and h. a first expansion device having an inlet in fluid communication with an outlet of the cold separator vapor cooling passage and an outlet in fluid communication with an inlet of the refrigeration passage.

2. The system of claim 1 wherein the interstage separation device has a liquid outlet.

3. The system of claim 2, wherein the interstage pump having an inlet in fluid communication with the liquid outlet of the interstage separation device and an outlet in fluid communication with the high pressure separation device.

4. The system of claim 1 further comprising:

i. a mid-temperature separation device having vapor and liquid outlets in fluid communication with the refrigeration passage;

j. a second expansion device having a second expansion device inlet in fluid communication with the outlet of the cold separator liquid cooling passage and a second expansion device outlet in fluid communication with the mid-temperature separation device;

k. a third expansion device having a third expansion device inlet in fluid communication with the outlet of the high pressure liquid cooling passage and a third expansion device outlet in fluid communication with the mid-temperature separation device.

5. The system of claim 4 wherein wherein the interstage separation device includes a liquid outlet and the main heat exchanger includes a low pressure liquid cooling passage configured to receive and cool a low pressure liquid stream from the liquid outlet of the interstage separation device and further comprising:

1. a fourth expansion device having a fourth expansion device inlet configured to receive a cooled low pressure liquid stream from the low pressure cooling passage of the heat exchanger and a fourth expansion device outlet in fluid communication with the mid-temperature separation device.

6. The system of claim 5 wherein the feed cooling passage includes a feed cooling passage first portion having a pre-treatment outlet and a feed cooling passage second portion having a post-treatment inlet and further comprising:

m. a treatment system separation device configured to receive a fluid stream from the pre-treatment outlet of the feed cooling passage first portion, said treatment separation device having a treatment separation device vapor outlet configured to direct vapor from the treatment separation device to the post-treatment inlet of the feed cooling passage second portion, said treatment system separation device also having treatment system separation device liquid outlet;

n. a treatment system heat exchanger configured to receive a feed liquid stream from the liquid outlet of the treatment separation device and a mixed refrigerant liquid treatment stream from the high pressure separation device so that the feed liquid stream is warmed and the mixed refrigerant liquid treatment stream is cooled in the treatment system heat exchanger;

o. a condensate stripping column configured to receive a warmed feed liquid stream from the treatment system heat exchanger;

p. said treatment system heat exchanger configured to direct a cooled mixed refrigerant liquid treatment stream to the mid-temperature separation device.

7. The system of claim 4 wherein the feed cooling passage includes a feed cooling passage first portion having a pre-treatment outlet and a feed cooling passage second portion having a post-treatment inlet and further comprising:

1 a treatment system separation device configured to receive a fluid stream from the pre-treatment outlet of the feed cooling passage first portion, said treatment separation device having a treatment separation device vapor outlet configured to direct vapor from the treatment separation device to the post-treatment inlet of the feed cooling passage second portion, said treatment system separation device also having treatment system separation device liquid outlet;

m. a treatment system heat exchanger configured to receive a feed liquid stream from the liquid outlet of the treatment separation device and a mixed refrigerant liquid treatment stream from the high pressure separation device so that the feed liquid stream is warmed and the mixed refrigerant liquid treatment stream is cooled in the treatment system heat exchanger;

n. a condensate stripping column configured to receive a warmed feed liquid stream from the treatment system heat exchanger;

o. said treatment system heat exchanger configured to direct a cooled mixed refrigerant liquid treatment stream to the mid-temperature separation device.

8. The system of claim 1 wherein the feed cooling passage includes a feed cooling passage first portion having a pre-treatment outlet and a feed cooling passage second portion having a post-treatment inlet and further comprising:

i. a treatment system separation device configured to receive a fluid stream from the pre-treatment outlet of the feed cooling passage first portion, said treatment separation device having a treatment separation device vapor outlet configured to direct vapor from the treatment separation device to the post-treatment inlet of the feed cooling passage second portion, said treatment system separation device also having treatment system separation device liquid outlet;

j. a treatment system heat exchanger configured to receive a feed liquid stream from the liquid outlet of the treatment separation device and a mixed refrigerant liquid treatment stream from the high pressure separation device so that the feed liquid stream is warmed and the mixed refrigerant liquid treatment stream is cooled in the treatment system heat exchanger;

k. a condensate stripping column configured to receive a warmed feed liquid stream from the treatment system heat exchanger.

9. The system of claim 1 wherein the feed cooling passage includes a feed cooling passage first portion having a pre-treatment outlet and a feed cooling passage second portion having a post-treatment inlet and further comprising:

i. a treatment system separation device configured to receive a fluid stream from the pre-treatment outlet of the feed cooling passage first portion, said treatment separation device having a treatment separation device vapor outlet configured to direct vapor from the treatment separation device to the post-treatment inlet of the feed cooling passage second portion, said treatment system separation device also having treatment system separation device liquid outlet;

j. a treatment system heat exchanger configured to receive a feed liquid stream from the liquid outlet of the treatment separation device and a mixed refrigerant liquid treatment stream from the high pressure separation device so that the feed liquid stream is warmed and the mixed refrigerant liquid treatment stream is cooled in the treatment system heat exchanger;

k. a condensate stripping column configured to receive a warmed feed liquid stream from the treatment system heat exchanger.

10. The system of claim 1 wherein the high pressure liquid cooling passage has a high pressure cooling passage length and the cold separator liquid cooling passage has a cold separator liquid cooling passage length where the high pressure cooling passage length is greater than the cold separator liquid cooling passage length.

* * * * *